US007029346B2

(12) United States Patent
Yoshida et al.

(10) Patent No.: US 7,029,346 B2
(45) Date of Patent: Apr. 18, 2006

(54) VERTICAL ENGINE AND OUTBOARD ENGINE SYSTEM

(75) Inventors: Hiroyuki Yoshida, Saitama (JP); Yoshihiko Fukuda, Saitama (JP); Hiroki Tawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/852,701

(22) Filed: May 25, 2004

(65) Prior Publication Data

US 2005/0009420 A1 Jan. 13, 2005

(30) Foreign Application Priority Data

May 26, 2003 (JP) ..... 2003-147371
May 26, 2003 (JP) ..... 2003-147372

(51) Int. Cl.
*B63H 21/10* (2006.01)

(52) U.S. Cl. ..... 440/88 L; 440/88 C; 123/196 W

(58) Field of Classification Search ..... 440/88 L, 440/88 C, 88 D, 88 HE; 123/196 R, 196 AB, 123/196 W
See application file for complete search history.

(56) References Cited

U.S. PATENT DOCUMENTS 4,831,980 A * 5/1989 Nasu et al. ..... 123/196 A
5,934,241 A * 8/1999 Von Esebeck et al. .. 123/196 R
2002/0035983 A1* 3/2002 Kobayashi ..... 123/196 M
2002/0137406 A1* 9/2002 Wada et al. ..... 440/88
2003/0062017 A1* 4/2003 Yomo et al. ..... 123/196 AB

FOREIGN PATENT DOCUMENTS

JP 11-148329 6/1999

* cited by examiner

*Primary Examiner*—Stephen Avila
(74) *Attorney, Agent, or Firm*—Arent Fox PLLC

(57) ABSTRACT

A base member mounted to a side of a cylinder block is formed with an inlet-side oil supply passage for supplying an oil to an oil filter, and an outlet-side oil supply passage for discharging the oil from the oil filter. As a result, it is unnecessary to increase the thickness of a wall of the cylinder block or to form a bulged portion in order to form the oil supply passages, thereby contributing to a decrease in weight of the cylinder block. Moreover, because the oil supply passages are formed in the base member, the layouts thereof can be determined freely without restrained by the shape of the cylinder block, thereby contributing an increase in degree of freedom for the design.

14 Claims, 23 Drawing Sheets

UPPER SURFACE OF MOUNT CASE

LOWER SURFACE OF PUMP BODY

LOWER SURFACE OF ENGINE SUBASSEMBLY

VERTICAL ENGINE AND OUTBOARD ENGINE SYSTEM

BACKGROUND OF THE INVENTION

1. Field of the Invention

The present invention relates to a vertical engine including a crankshaft disposed in a generally vertical direction, and to an outboard engine system including such a vertical engine mounted thereon.

2. Description of the Related Art

Japanese Patent Application Laid-open No. 11-148329 discloses an outboard engine system having a vertical engine mounted thereon in which an oil passage for supplying an oil from an oil pan to an oil filter mounted on a side of a cylinder block is formed in a wall surface of the cylinder block by withdrawing a core pin during formation of the cylinder block in die-casting, or formed by drilling after the formation of the cylinder block.

In the outboard engine system described in the above-described Japanese Patent Application Laid-open No. 11-148329, the oil passage is provided utilizing a portion of a wall forming a section for accommodating a balancer shaft. In an engine having no balancer shaft disposed in a lateral direction of a cylinder, however, in order to form an oil passage having a predetermined inner diameter in a wall surface of a cylinder block and hence, it is necessary to form the entire wall surface of the cylinder block at an increased thickness or to form an bulged portion around the oil passage. For this reason, a useless wall portion is created to increase the weight of the cylinder block, and also there is a fear that the disposition of the oil passage is restrained by the shape of the cylinder block, resulting in a decrease in degree of freedom for a layout.

The oil supplied to portions to be lubricated of the engine bears a cooling function in addition to a lubricating function, and it is desirable that the oil having a temperature as low as possible is supplied to the portions to be lubricated. In the outboard engine system described in the above-described publications, it is difficult to extend a water jacket to the vicinity of a mounting seat of the oil filter supported in the cylinder block, and hence it is difficult to further cool the oil in the oil filter.

SUMMARY OF THE INVENTION

Accordingly, it is an object of the present invention to increase the degree of freedom in forming an oil passage leading to an oil filter disposed outside an engine subassembly of a vertical engine, and to enhance the effect of cooling an oil flowing through the oil filter.

To achieve the above object, according to a first feature of the present invention, there is proposed a vertical engine comprising a crankshaft disposed in a generally vertical direction, an engine subassembly including a crank chamber in which the crankshaft is accommodated, an oil pan disposed below the engine subassembly, an oil filter disposed outside the engine subassembly, and an oil path for supplying an oil from the oil pan via the oil filter to portions to be lubricated, wherein the oil path includes a first oil passage which has an oil inlet opening into a lower surface of the engine subassembly and which rises upwards within the engine subassembly, and a second oil passage provided separately from the engine subassembly and connecting a downstream portion of the first oil passage to an inlet of the oil filter.

With the above-described arrangement, the oil path for supplying the oil from the oil pan via the oil filter disposed outside the engine subassembly to the portions to be lubricated includes the first oil passage rising upwards within the engine subassembly, and the second oil passage which connects the downstream portion of the first oil passage to the inlet of the oil filter and which is provided separately from the engine subassembly. Therefore, the second oil passage can be formed without increasing the wall thickness of the engine subassembly and without forming a bulged portion. Thus, it is possible to minimize the useless wall portion of the engine subassembly to prevent an increase in weight, and to form the second oil passage freely without being restrained by the engine subassembly.

According to a second feature of the present invention, in addition to the first feature, the vertical engine further includes a third oil passage provided separately from the engine subassembly and connected to an outlet of the oil filter.

With the above-described arrangement, the third oil passage connected to the outlet of the oil filter is provided separately from the engine subassembly, and hence the third oil passage can be formed without increasing the wall thickness of the engine subassembly and without forming a bulged portion. Thus, it is possible to minimize the useless wall portion of the engine subassembly to prevent an increase in weight, and to form the third oil passage freely without being restrained by the engine subassembly.

According to a third feature of the present invention, there is proposed an outboard engine system provided with a vertical engine which comprises a crankshaft disposed in a generally vertical direction, a flywheel mounted at a lower end of the crankshaft, an engine subassembly including a crank chamber in which the crankshaft is accommodated, an oil pan disposed below the engine subassembly and below the flywheel, an oil filter disposed outside the engine subassembly, and an oil path for supplying an oil from the oil pan via the oil filter to portions to be lubricated, wherein the oil path includes a first oil passage which has an oil inlet opening into a lower surface of the engine subassembly and which rises upwards within the engine subassembly, a second oil passage provided separately from the engine subassembly and connecting a downstream portion of the first oil passage to an inlet of the oil filter, and a third oil passage provided separately from the engine subassembly and connected to an outlet of the oil filter.

With the above-described arrangement, the oil path for supplying the oil from the oil pan via the oil filter disposed outside the engine subassembly to the portions to be lubricated includes the first oil passage rising upwards within the engine subassembly, the second oil passage connecting the downstream portion of the first oil passage to the inlet of the oil filter, and the third oil passage connected to the outlet of the oil filter, and the second and third oil passages are provided separately from the engine subassembly. Therefore, the second and third oil passages can be formed without increasing the wall thickness of the engine subassembly and without forming a bulged portion. Thus, it is possible to minimize a useless wall portion of the engine subassembly to prevent an increase in weight, and to form the second and third oil passages freely without being restrained by the engine subassembly.

Moreover, the oil is supplied from the oil pan to the oil inlet opening into the lower surface of the engine subassembly and hence, even if the flywheel is disposed below the engine subassembly to decrease the vibration of the outboard engine system, it is easier to form the oil passages so as to avoid the interference with the flywheel.

According to a fourth feature of the present invention, there is proposed a vertical engine comprising a crankshaft disposed in a generally vertical direction, an engine subassembly including a crank chamber in which the crankshaft is accommodated, an oil pan disposed below the engine subassembly, an oil filter disposed outside the engine subassembly, and an oil path for supplying an oil from the oil pan via the oil filter to portions to be lubricated, wherein the oil path includes a first oil passage which has an oil inlet opening into a lower surface of the engine subassembly and which rises upwards within the engine subassembly, and a second oil passage which is formed in a base member fixed to the engine subassembly to support the oil filter, and which connects a downstream portion of the first oil passage to an inlet of the oil filter, the base member being formed with a water jacket facing an oil-filter mounting seat.

With the above-described arrangement, the oil path for supplying the oil from the oil pan via the oil filter disposed outside the engine subassembly includes the first oil passage rising upwards within the engine subassembly and the second oil passage connecting the downstream portion of the first oil passage to the inlet of the oil filter and provided in the base member fixed to the engine subassembly. Therefore, the second oil passage can be formed without increasing the wall thickness of the engine subassembly and without forming a bulged portion. Thus, it is possible to minimize a useless wall portion of the engine subassembly to prevent an increase in weight, and to form the second oil passage freely without being restrained by the engine subassembly.

Moreover, because the base member supporting the oil filter is formed with the water jacket facing the oil-filter mounting seat, it is possible not only to increase the degree of freedom for the layout of the water jacket as compared with a case where the water jacket is formed in a cylinder block, but also to ensure the volume of the water jacket over the substantially entire periphery of a mounting surface in the case where the oil filter is a cylindrical-cartridge type oil filter. In addition, there is no heat conduction toward the cylinder block and hence, a further cooling effect can be expected.

According to a fifth feature of the present invention, there is proposed a vertical engine comprising a crankshaft disposed in a generally vertical direction, an engine subassembly including a crank chamber in which the crankshaft is accommodated, an oil pan disposed below the engine subassembly, an oil filter disposed outside the engine subassembly, and an oil path for supplying an oil from the oil pan via the oil filter to portions to-be lubricated, wherein the oil path includes a first oil passage which has an oil inlet opening into a lower surface of the engine subassembly and which rises upwards within the engine subassembly, a second oil passage connecting a downstream portion of the first oil passage to an inlet of the oil filter, and a third oil passage connected to an outlet of the oil filter, the second and third oil passages being formed in a base member fixed to the engine subassembly to support the oil filter, the base member being formed with a water jacket facing the second oil passage, the third oil passage and an oil-filter mounting seat.

With the above-described arrangement, the oil path for supplying the oil from the oil pan via the oil filter disposed outside the engine subassembly to the portions to be lubricated includes the first oil passage rising upwards within the engine subassembly, the second oil passage connecting the downstream portion of the first oil passage to the inlet of the oil filter, and the third oil passage connected to the outlet of the oil filter, and the second and third oil passages are formed in the base member fixed to the engine subassembly. Therefore, the second and third oil passages can be formed without increasing the wall thickness of the engine subassembly and without forming a bulged portion. Thus, it is possible to minimize a useless wall portion of the engine subassembly to prevent an increase in weight, and to form the second and third oil passages freely without being restrained by the engine subassembly.

Moreover, because the base member supporting the oil filter is formed with the water jacket facing the second oil passage, the third oil passage and the oil-filter mounting seat, it is possible not only to increase the degree of freedom for the layout of the water jacket to effectively cool the second oil passage and the third oil passage as compared with a case where the water jacket is formed in a cylinder block, but also to ensure the volume of the water jacket over the substantially entire periphery of a mounting surface in the case where the oil filter is a cylindrical-cartridge type oil filter. In addition, there is no heat conduction toward the cylinder block and hence, a further cooling effect can be expected.

According to a sixth feature of the present invention, in addition to the fourth or fifth feature, the portions to be lubricated include sliding surfaces of a cylinder and a piston.

With the above-described arrangement, the oil can be cooled sufficiently by the oil filter, and hence the sliding portions of the cylinder and the piston can be lubricated and cooled effectively.

According to a seventh feature of the present invention, in addition to the fourth or fifth feature, the portions to be lubricated include a timing chain adapted to drive a camshaft by the crankshaft.

With the above-described arrangement, the oil can be cooled sufficiently by the oil filter and hence, the timing chain can be lubricated and cooled effectively by the oil.

According to an eighth feature of the present invention, there is proposed an outboard engine system provided with a vertical engine having any of the fourth or fifth feature, wherein a flywheel mounted is at a lower end of the crankshaft.

With the above-described arrangement, the oil is supplied from the oil pan to the oil inlet opening into the lower surface of the engine subassembly and hence, even if the fly wheel is disposed below the engine subassembly to decrease the vibration of the outboard engine system, it is easier to form the oil path so as to avoid the interference with the flywheel.

An oil supply bore 11*m* in an embodiment corresponds to the oil inlet of the present invention; an oil supply passage 11*v* in the embodiment corresponds to the first oil passage of the present invention; an inlet-side oil supply passage 108*b* in the embodiment corresponds to the second oil passage of the present invention; an outlet-side oil supply passage 108*c* in the embodiment corresponds to the third oil passage of the present invention.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an embodiment shown in the accompanying drawings.

Figure 1:
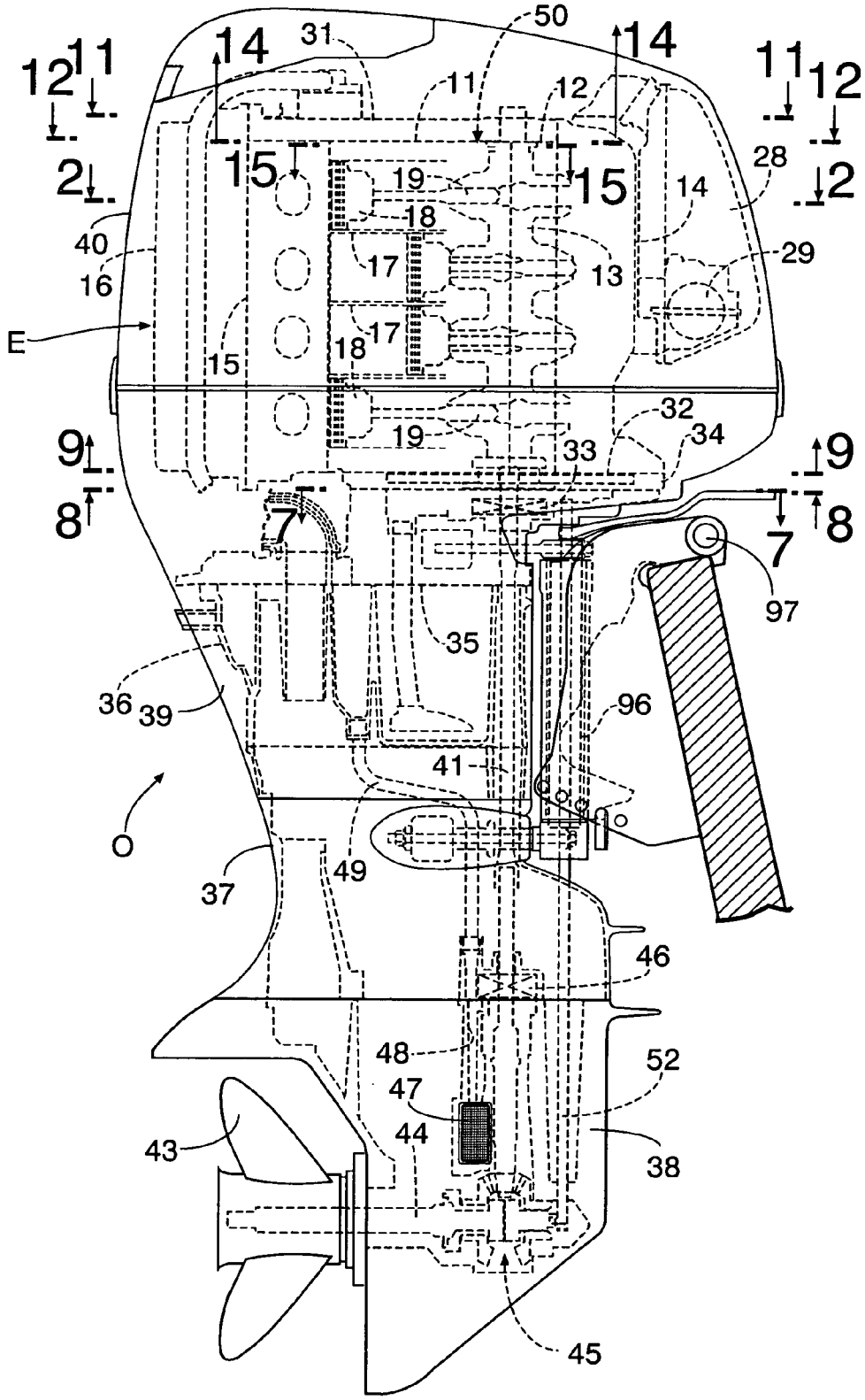
FIG. 1 is a side view of the entirety of an outboard engine system according to one embodiment of the present invention.
Figure 2:
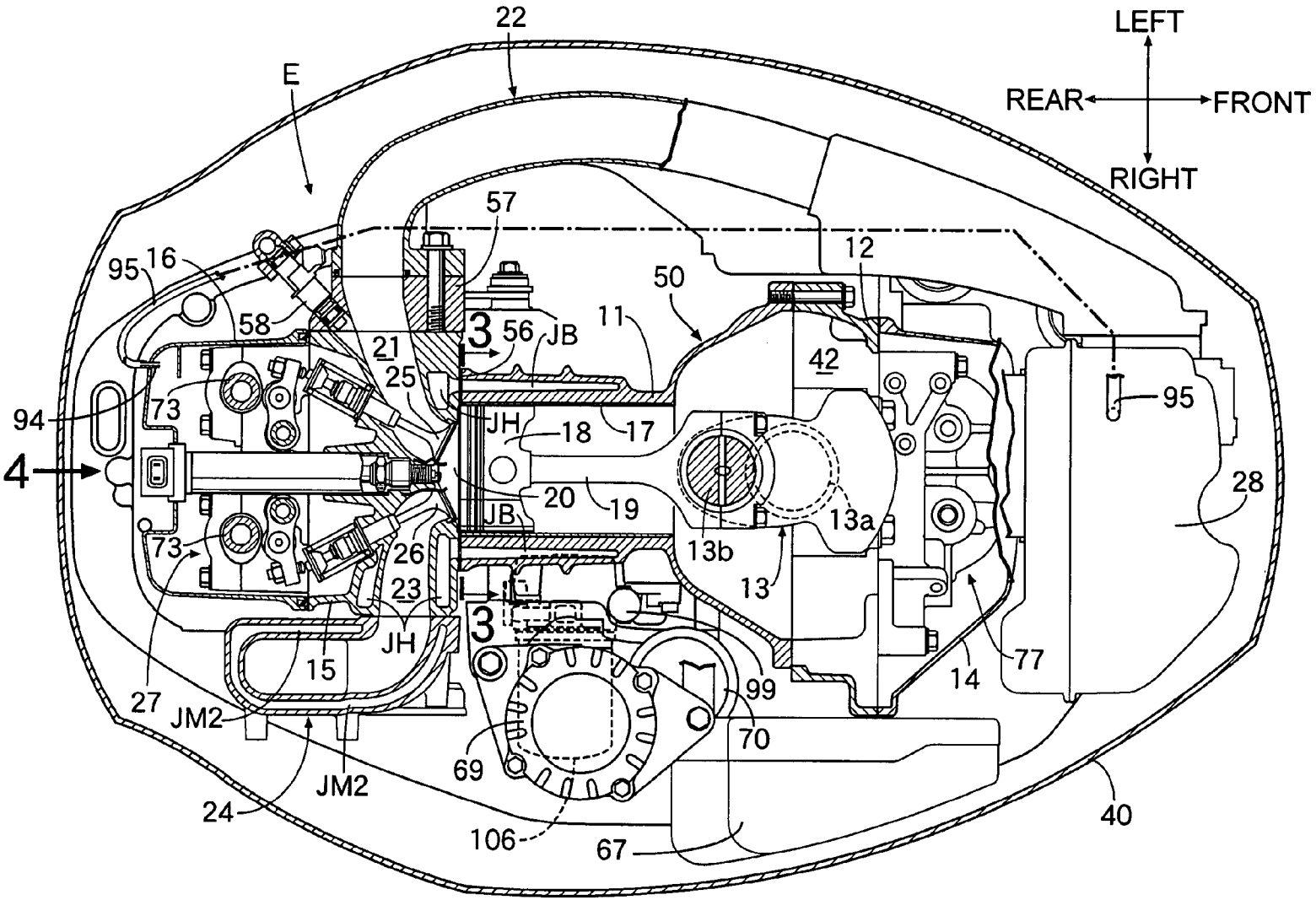
FIG. 2 is an enlarged sectional view taken along a line 2—2 in FIG. 1.
Figure 3:
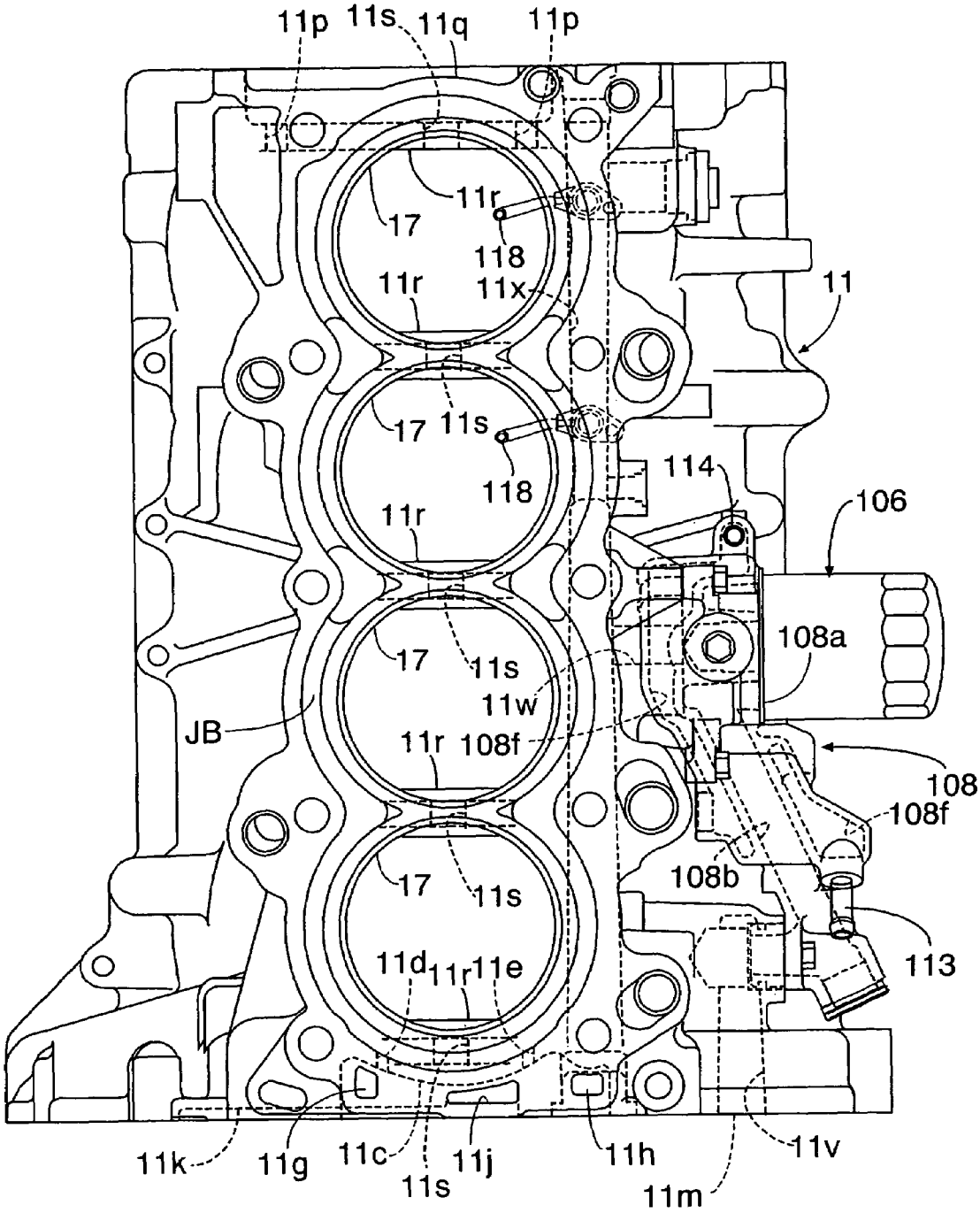
FIG. 3 is an enlarged sectional view taken along a line 3—3 in FIG. 2.

As shown in FIGS. 1 to 3, an outboard engine system O is mounted on a hull so that it can perform a steering motion in a lateral direction about a steering shaft 96 and a tiling motion in a vertical direction about a tilting shaft 97. A water-cooled vertical engine E of an in-line 4-cylinder and 4-stroke type mounted at an upper portion of the outboard engine system O includes a cylinder block 11, a lower block 12 coupled to a front surface of the cylinder block 11, a crankshaft 13 disposed in a generally vertical direction and supported so that five journals 13*a*, 13*a*, 13*a*, 13*a*, 13*a* (hereinafter referred to as 13*a* for simplification) are interposed between the cylinder block 11 and the lower block 12, a crankcase 14 coupled to a front surface of the lower block 12, a cylinder head 15 coupled to a rear surface of the cylinder block 11, and a head cover 16 coupled to a rear surface of the cylinder head 15. Four pistons 18, 18, 18, 18 (hereinafter referred to as 18 for simplification) slidably received in four sleeve-shaped cylinders 17, 17, 17, 17 (hereinafter referred to as 17 for simplification) cast in the cylinder block 11 are connected to four crankpins 13*b*, 13*b*, 13*b*, 13*b* (hereinafter referred to as 13*b* for simplification) of the crankshaft 13 through four connecting rods 19, 19, 19, 19 (hereinafter referred to as 19 for simplification), respectively.

The cylinder block 11, the lower block 12, the crankcase 14 and the cylinder head 15 constitute an engine subassembly 50 of the present invention, and a space defined by the cylinder block 11, the lower block 12 and the crankcase 14 for accommodation of the crankshaft 13 constitutes a crank chamber 42 of the present invention.

Combustion chambers 20 formed in the cylinder head 15 so that they are opposed to top surfaces of the pistons 18, are connected to an intake manifold 22 through intake ports 21 opening into a left side of the cylinder head 15, i.e., toward a port in a travel direction of the boat, and also connected to an exhaust passage 24 in an engine room through exhaust ports 23 opening into a right side of the cylinder head 15. Intake valves 25 adapted to open and close downstream ends of the intake ports 21 and exhaust valves 26 adapted to open and close upstream ends of the exhaust ports 23 are driven to be opened and closed by a valve-operating mechanism 27 of a DOHC type accommodated within the head cover 16. An upstream portion of the intake manifold 22 is connected to a throttle valve 29 fixed to a front surface of the crankcase 14, so that intake air passed through a silencer 28 is supplied to the intake manifold 22. Injectors 58 for injecting a fuel into the intake ports 21 are mounted in an injector base 57 interposed between the cylinder head 15 and the intake manifold 22.

Figure 6:
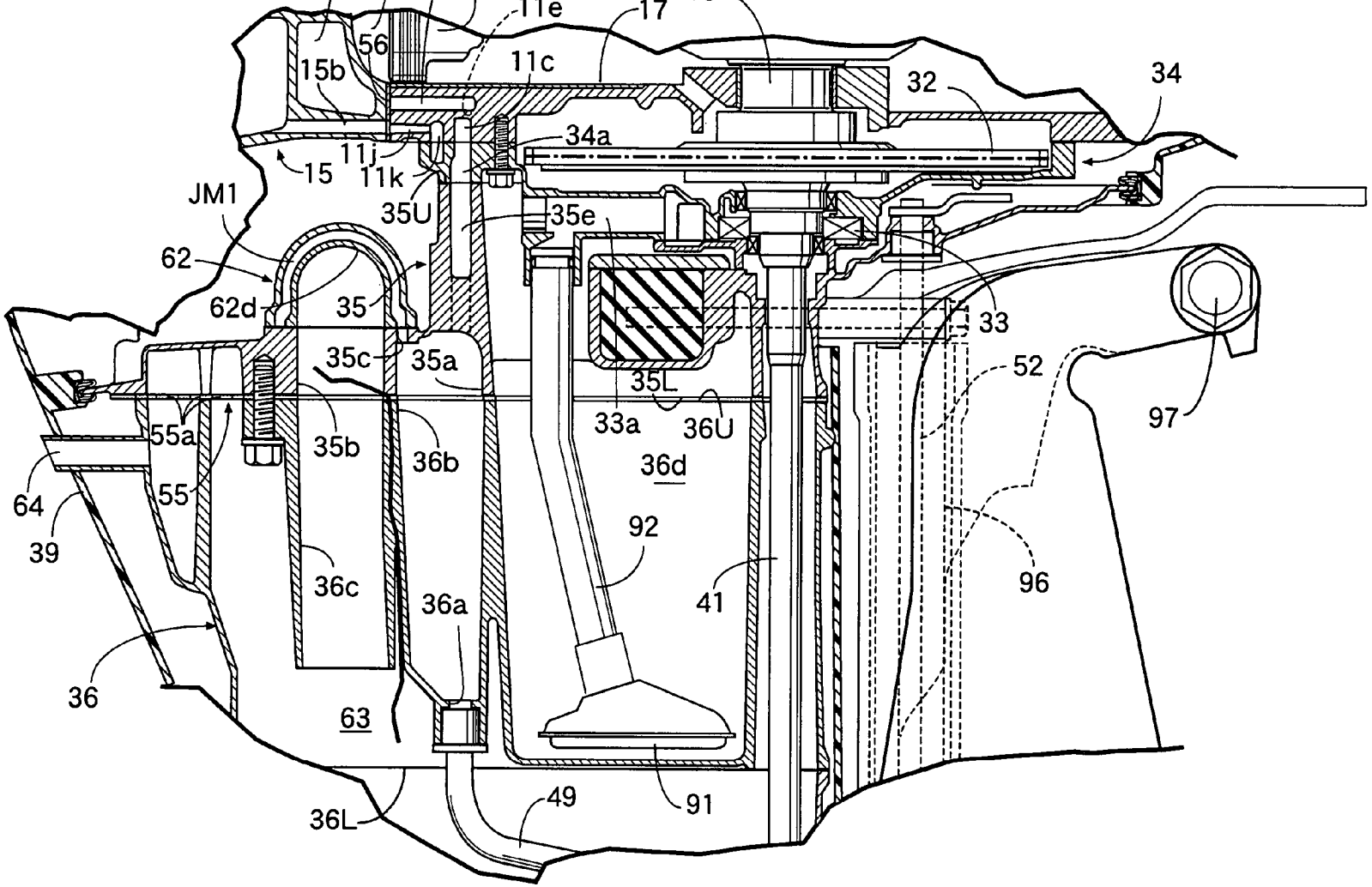
FIG. 6 is an enlarged sectional view of essential portions of FIG. 1.

An internal space in the head cover 16 accommodating the valve-operating mechanism 27 is connected to the silencer 28 through a coupling 94 and a breather pipe 95, and a blow-by gas leaked into the internal space in the head cover 16 is returned to an intake system. Reference numeral 67 in FIG. 6 is electric equipment box for accommodation of electric equipment; reference numeral 69 is an AC generator; reference numeral 70 is a starter motor; and reference numeral 99 is a pressure sensor for detecting a hydraulic pressure. The AC generator 69 is driven through a belt by a pulley 68 (see FIG. 13) mounted at an upper end of the crankshaft 13.

A chain cover 31 for accommodation of a timing chain 30 (see FIGS. 12, 13 and 21) for transmitting a driving force from the crankshaft 13 to the valve-operating mechanism 27 is coupled to upper surfaces of the cylinder block 11, the lower block 12, the crankcase 14 and the cylinder head 15 of the vertical engine E. An oil pump body 34 is coupled to lower surfaces of the cylinder block 11, the lower block 12 and the crankcase 14. Further, amount case 35, an oil case 36, an extension case 37 and a gear case 38 are coupled sequentially to a lower surface of the oil pump body 34.

The oil pump body 34 is adapted to accommodate the oil pump 33 between its lower surface and an upper surface of the mount case 35. A flywheel 32 is disposed between the oil pump body 34 and lower surfaces of the cylinder block 11 and the like opposite from the oil pump body 34, and a flywheel chamber and an oil pump chamber are defined by the oil pump body 34. The oil case 36, the mount case 35 and a periphery of a lower portion of the vertical engine E are covered with an undercover 39 made of a synthetic resin, and an upper portion of the vertical engine E is covered with an engine cover 40 made of a synthetic resin and coupled to an upper surface of the undercover 39.

A drive shaft 41 connected to a lower end of the crankshaft 13 extends downwards into the extension case 37 through the pump body 34, the mount case 35 and the oil case 36, and is connected, through a forward/backward travel switch over mechanism 45 operated by a shifting rod 52, to a front end of a propeller shaft 44 which is provided at its rear end with a propeller 43 and supported longitudinally in the gear case 38. A lower water supply passage 48 extending upwards from a strainer 47 mounted on the gear case 38 is connected to a cooling-water pump 46 mounted on the drive shaft 41.

As shown in FIG. 6, a cooling-water supply bore 36*a* is formed in a lower surface 36L of the oil case 36, and an upper water supply pipe 49 is connected at its upper end to the cooling-water supply bore 36*a*. A cooling-water supply passage 36*b* leading to the cooling-water supply bore 36*a* is formed in an upper surface 36U of the oil case 36 to surround a portion of a periphery of an exhaust pipe portion 36*c* integrally formed on the oil case 36. A cooling-water supply passage 35*a* having the same shape as the cooling-water supply passage 36*b* and opening into the upper surface 36U of the oil case 36 is formed in a lower surface 35L of the mount case 35 to surround a portion of a periphery of an exhaust passage 35*b* extending through the mount case 35.

Figure 7:
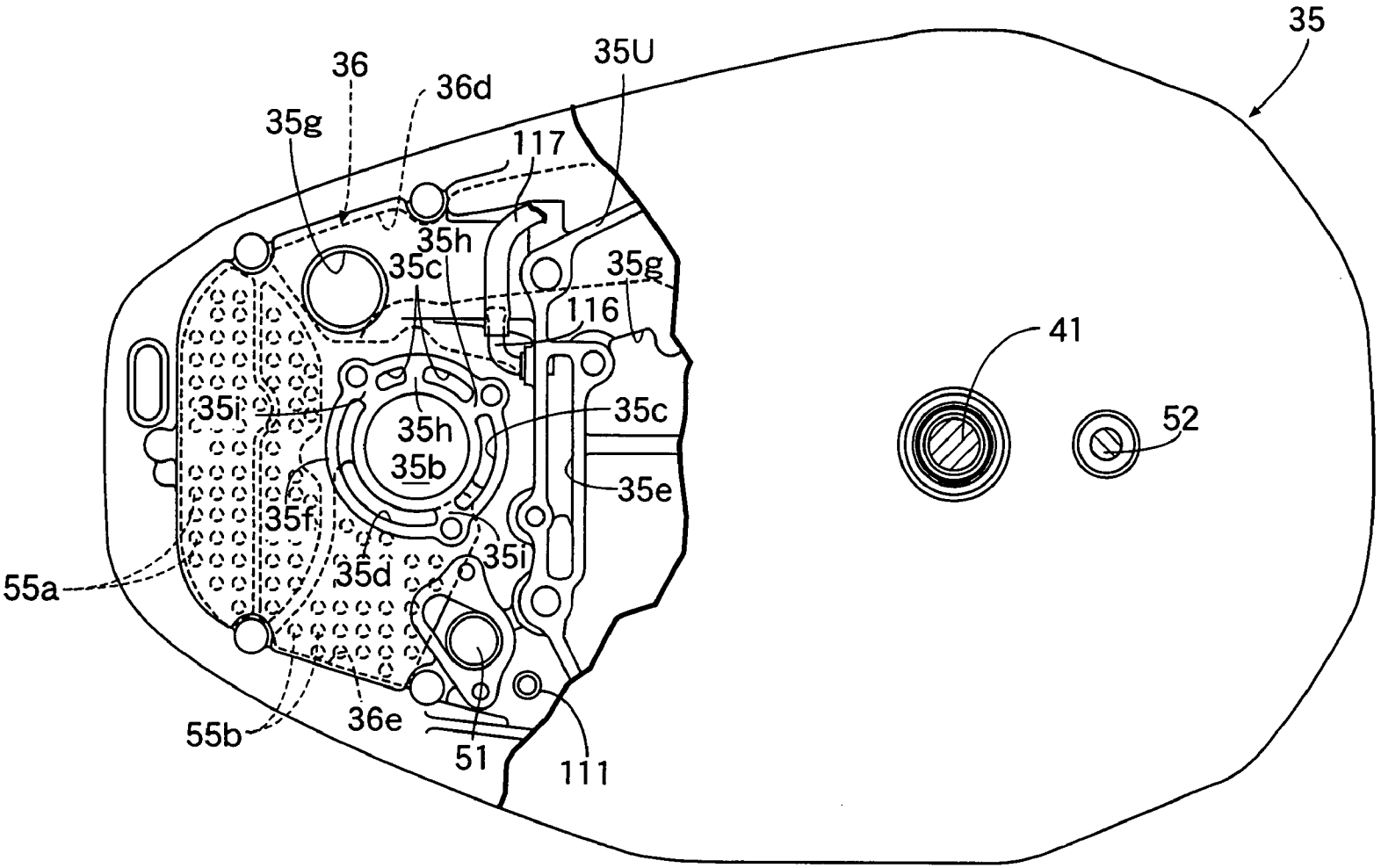
FIG. 7 is an enlarged view (a top view of a mount case) taken along a line 7—7 in FIG. 1.
Figure 8:
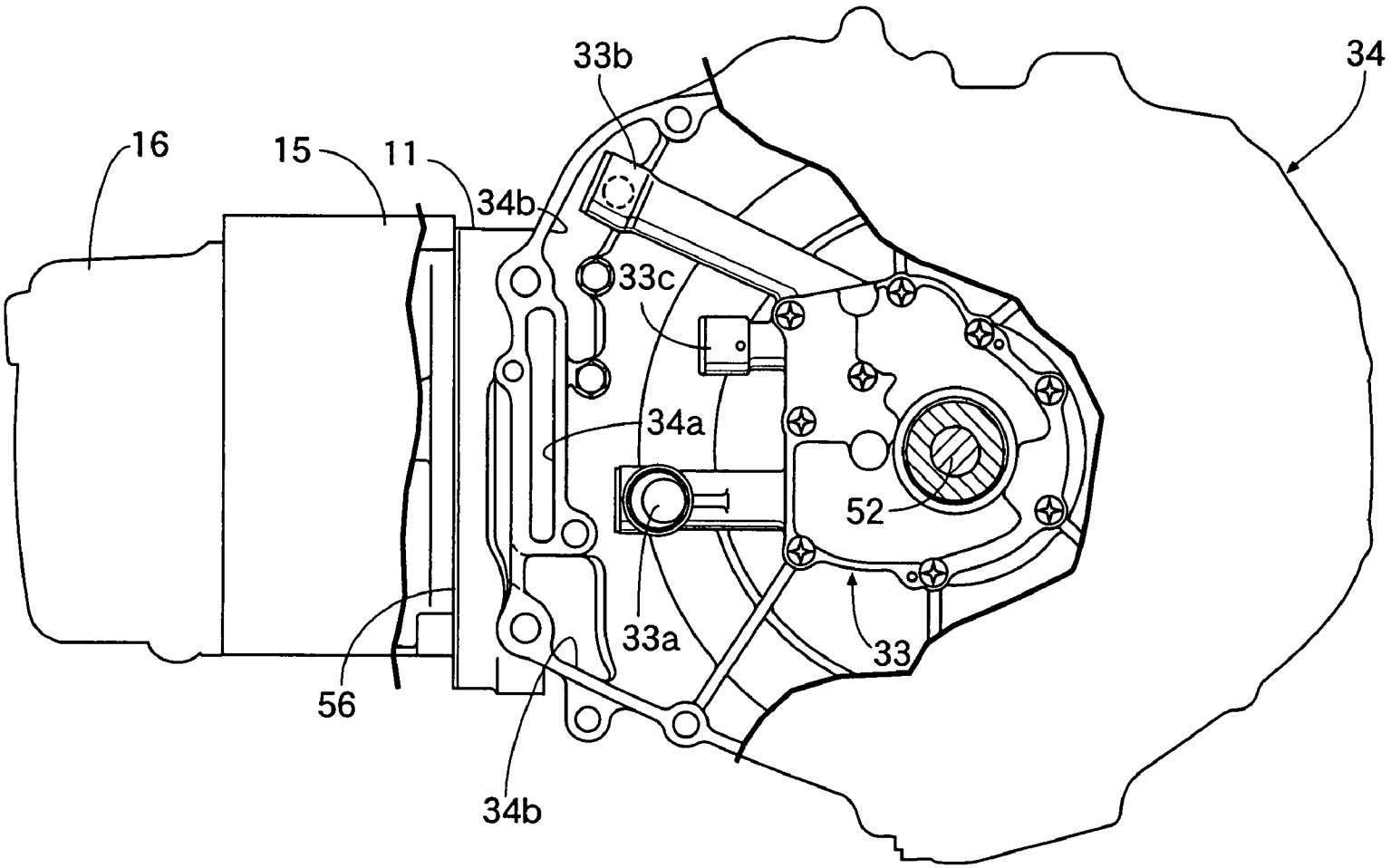
FIG. 8 is an enlarged view (a bottom view of a pump body) along a line 8—8 in FIG. 1.
Figure 9:
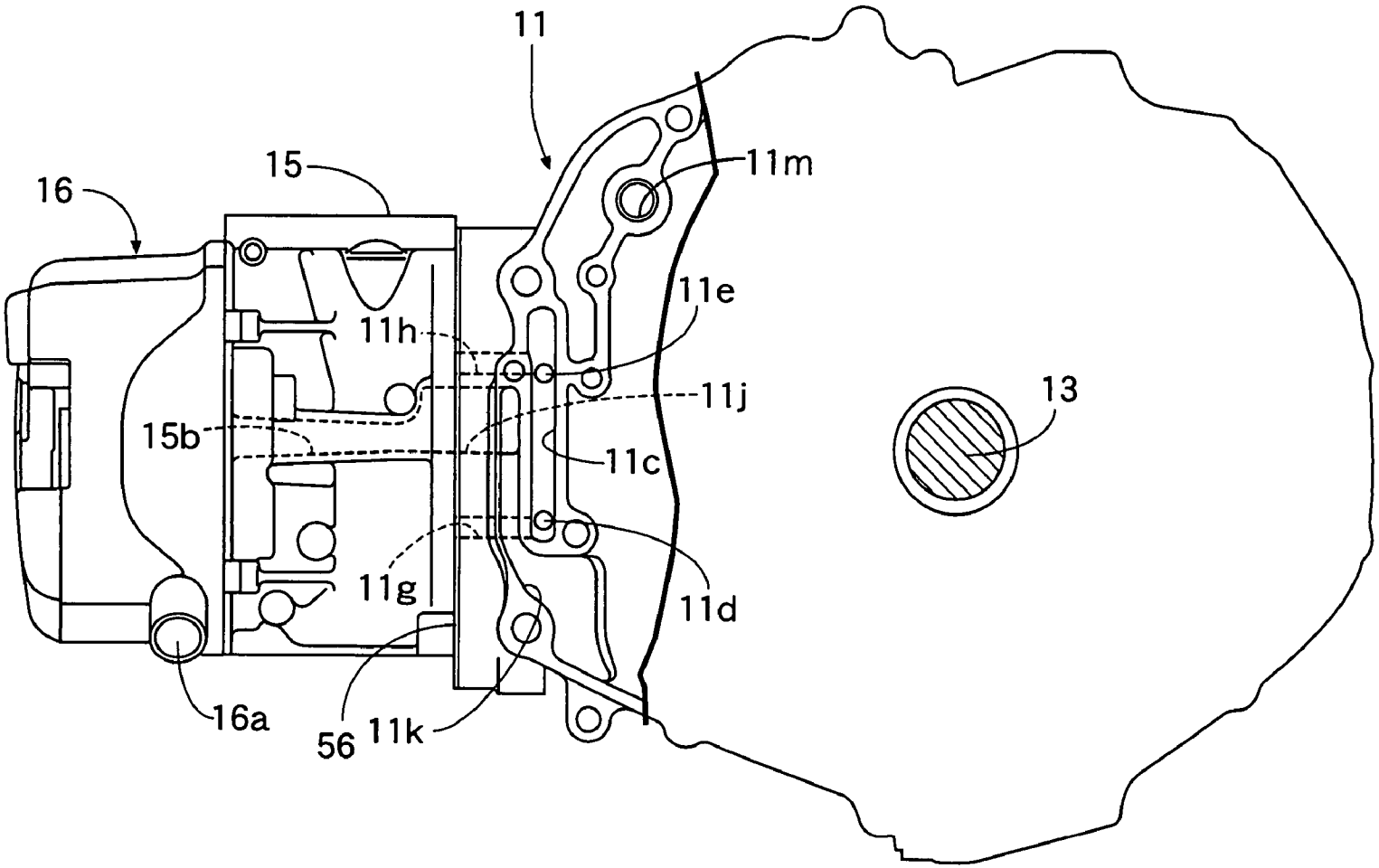
FIG. 9 is an enlarged view (a bottom view of an engine subassembly) along a line 9—9 in FIG. 1.
Figure 10:
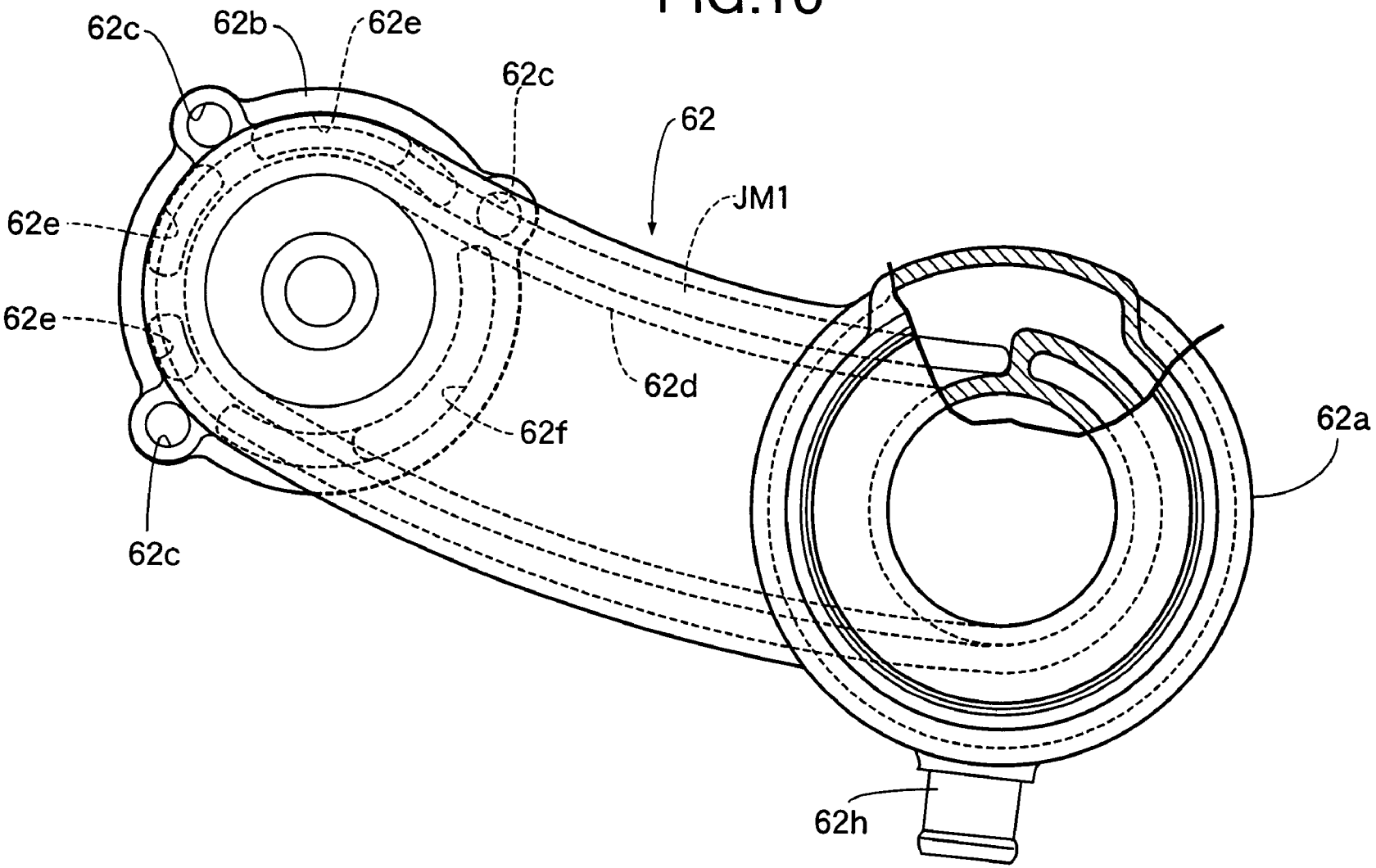
FIG. 10 is an enlarged view taken along a line 10—10 in FIG. 4.

FIG. 7 is a view of the mount case 35 as viewed from above, to a lower surface of which the oil case 36 is coupled. An outer periphery of the exhaust passage 35*b* is surrounded by cooling-water supply passages 35*c* and a cooling-water discharge passage 35*d*. More specifically, the cooling-water supply passages 35*c* (see FIG. 6) communicating with the cooling-water supply passage 35*a* formed to open downwards into the lower surface 35L of the mount case 35 are formed so that they open upwards into a portion of an upper surface 35U of the mount case 35 other than a portion where the cylinder block is mounted, and so that they extend along an outer periphery of the cylindrical discharge passage 35*b*. In the embodiment, the three arcuate cooling-water supply passages 35*c* are separated from one another by wall portions 35*h* continuous to an outer wall of the exhaust passage 35*b*. Further, the single arcuate cooling-water discharge passage 35*d* is formed outside an area in which the cooling-water supply passages 35*c* are provided and which is around an outer periphery of the cylindrical discharge passage 35*b*. The arcuate cooling-water discharge passage 35*d* is separated from the cooling-water supply passages 35*c* by wall portions 35*i* formed on the outer wall.

A cooling-water supply passage 35*e* is formed into a U-groove shape in the upper surface 35U of the mount case 35 to extend laterally of the outboard engine system O astride a central portion of the cylinder 17 as viewed in a plane and to open upwards into the upper surface 35U (see FIG. 6). The cooling-water supply passage 35*a* extends upwards to communicate with the cooling-water supply passage 35*e*. A relief valve 51 is mounted on the upper surface 35U of the mount case 35 and adapted to be opened to release cooling water when the pressure in the cooling-water supply passage 35*a* increases to a predetermined value or more (see FIGS. 4 and 7). A coupling 116 (see FIG. 7) leading to the cooling-water supply passage 35*e* is connected to a water-examining port 66 (see FIG. 22) through a hose 117.

The cooling-water discharge passage 35*d* communicates with an exhaust chamber 63 formed within the oil case 36, the extension case 37 and the gear case 38, through openings 36*e* (see FIG. 7) formed in the entire area of the lower surface 36L of the oil case 36. A gasket 55 interposed between the lower surface 35L of the mount case 35 and the upper surface 36U of the oil case 36 is provided with punched bores 55a through which the cooling water dropped from the cooling-water discharge passage 35*d* (see FIG. 7) of the mount case 35 is passed, and punched bores 55*b* defining a portion of the expansion chamber 63 to exhibit a silencing effect (see FIGS. 6 and 7).

The structure of the exhaust passage 24 within the engine room will be described below with reference to FIGS. 4 to 6 and 10.

An exhaust passage means for the vertical engine E is divided mainly into the exhaust passage 24 section within the engine room, and an exhaust chamber section separated from the engine room. The exhaust passage 24 within the engine room has an exhaust manifold 61 including: single pipe portions 61*a* which are coupled to a right side of the cylinder head 15, as described hereinafter, and into each of which an exhaust gas from each of the combustion chamber 20 is introduced, and a collection portion 61*b* in which the pipe portions 61*a* are collected at their downstream portions; and an exhaust gas guide 62 connected to the exhaust manifold 61 through a coupling portion 62*a* for guiding the exhaust gas to the outside of the engine room.

As can be seen from FIG. 6, the exhaust gas guide 62 is coupled to the upper surface 35U of the mount case 35 forming a partition wall of the engine room, to communicate with the exhaust passage 35*b* extending through the mount case 35. The exhaust passage 35*b* communicates with the exhaust pipe portion 36*c* integrally formed on the oil case 36 and also communicates with the exhaust chamber 63. In the embodiment, the oil case 36 forms an outer wall of the exhaust chamber 63 and also forms the exhaust pipe portion 36*c*, but in another construction, the exhaust pipe portion 36*c* may be a separate passage. The exhaust passage means may be of a construction in which a portion thereof is integrally continuous, but by forming the exhaust passage 24 within the engine room and the passages outside the engine room separately from each other, the assemblability of the various members and the sealability to the exhaust chamber 63 can be ensured.

An upper portion of the exhaust chamber 63 communicates with the outside of the undercover 39 through an exhaust gas discharge pipe 64 provided on the oil case 36, so that the exhaust gas is discharged into the atmosphere through the exhaust gas discharge pipe 64 without being discharged into water during the low-load operation of the vertical engine E.

A flange 62*b* formed at a lower end of the exhaust gas guide 62 is formed with three bolt bores 62*c*, three cooling-water inlet ports 62*e* defined into an arcuate shape to surround an exhaust passage 62*d*, and a single cooling-water outlet port 62*f*. When the flange 62*b* of the exhaust gas guide 62 is bolted to a mounting seat 35*f* (see FIG. 7) on the upper surface 35U of the mount case 35, the cooling-water inlet ports 62*e* in the exhaust gas guide 62 is brought into communication with the cooling-water supply passages 35*c* in the mount case 35, and the cooling-water outlet port 62*f* is brought into communication with the cooling-water discharge passage 35*d* in the mount case 35. On the side of the mounting seat 35*f* closer to the lower surface 35L of the mount case 35, aside of the outer wall forming the cooling-water discharge passage 35*d* opposite from the exhaust passage 35*b* lies at a location slightly higher in level than a gasket surface, and the cooling water is discharged from between a lower surface of the outer wall and the gasket surface onto a gasket 55.

The exhaust gas guide 62 is formed with a first exhaust gas guide-cooling water jacket JM1 covering a half of a periphery of an upper surface of the exhaust passage 62*d*, and a second exhaust gas guide-cooling water jacket JM3 covering a half of a periphery of a lower surface of the exhaust passage 62*d*. An exhaust manifold-cooling water jacket JM2 is formed to surround a periphery of the exhaust manifold 61, and when a lower end of the exhaust manifold 61 is fitted to an inner periphery of the coupling portion 62*a* of the exhaust gas guide 62, the exhaust manifold-cooling water jacket JM2 in the exhaust manifold 61 and the first exhaust gas guide-cooling water jacket JM1 in the exhaust gas guide 62 are brought into communication with each other.

Figure 4:
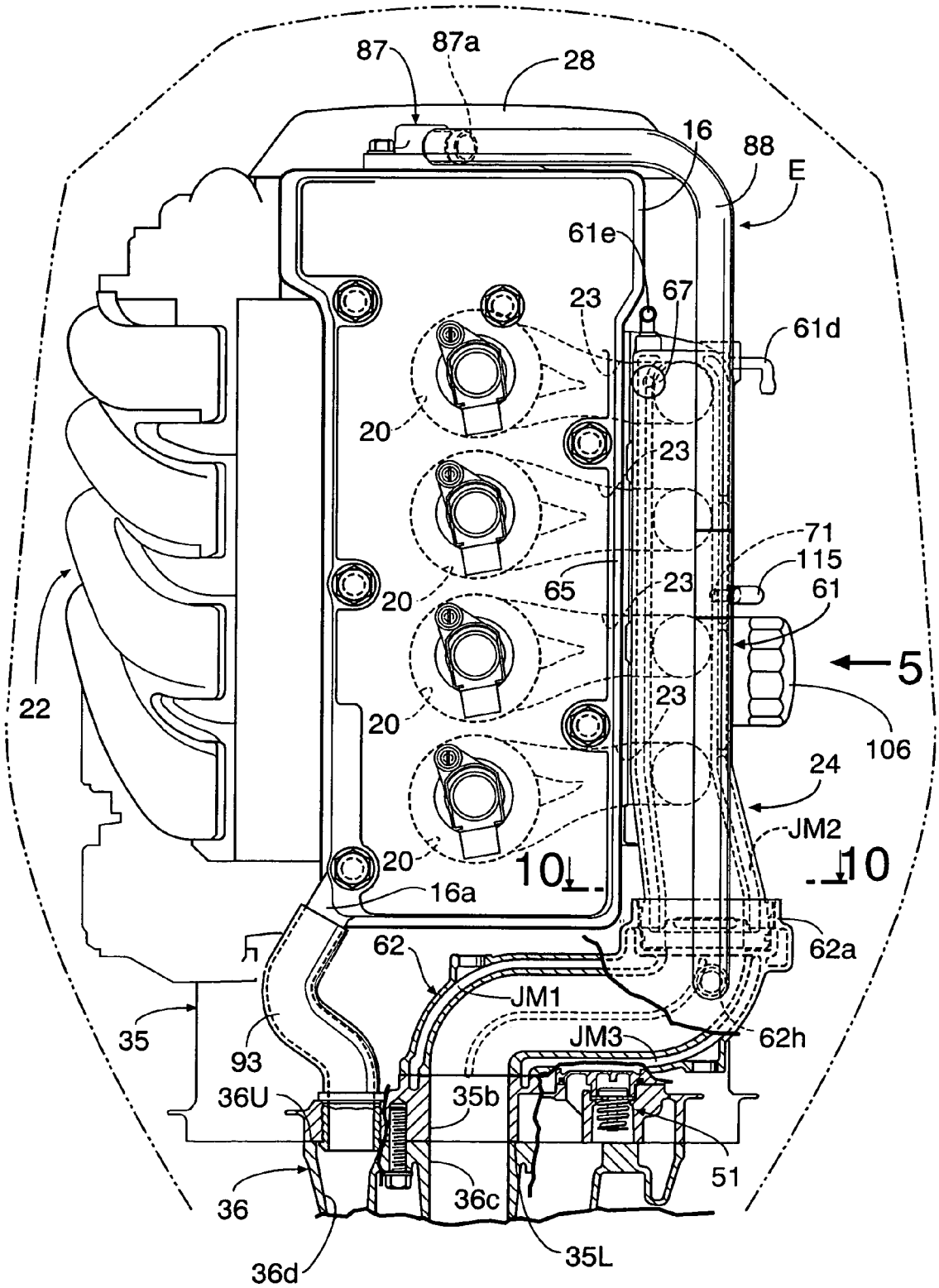
FIG. 4 is an enlarged view taken in a direction of an arrow 4 in FIG. 2.
Figure 5:
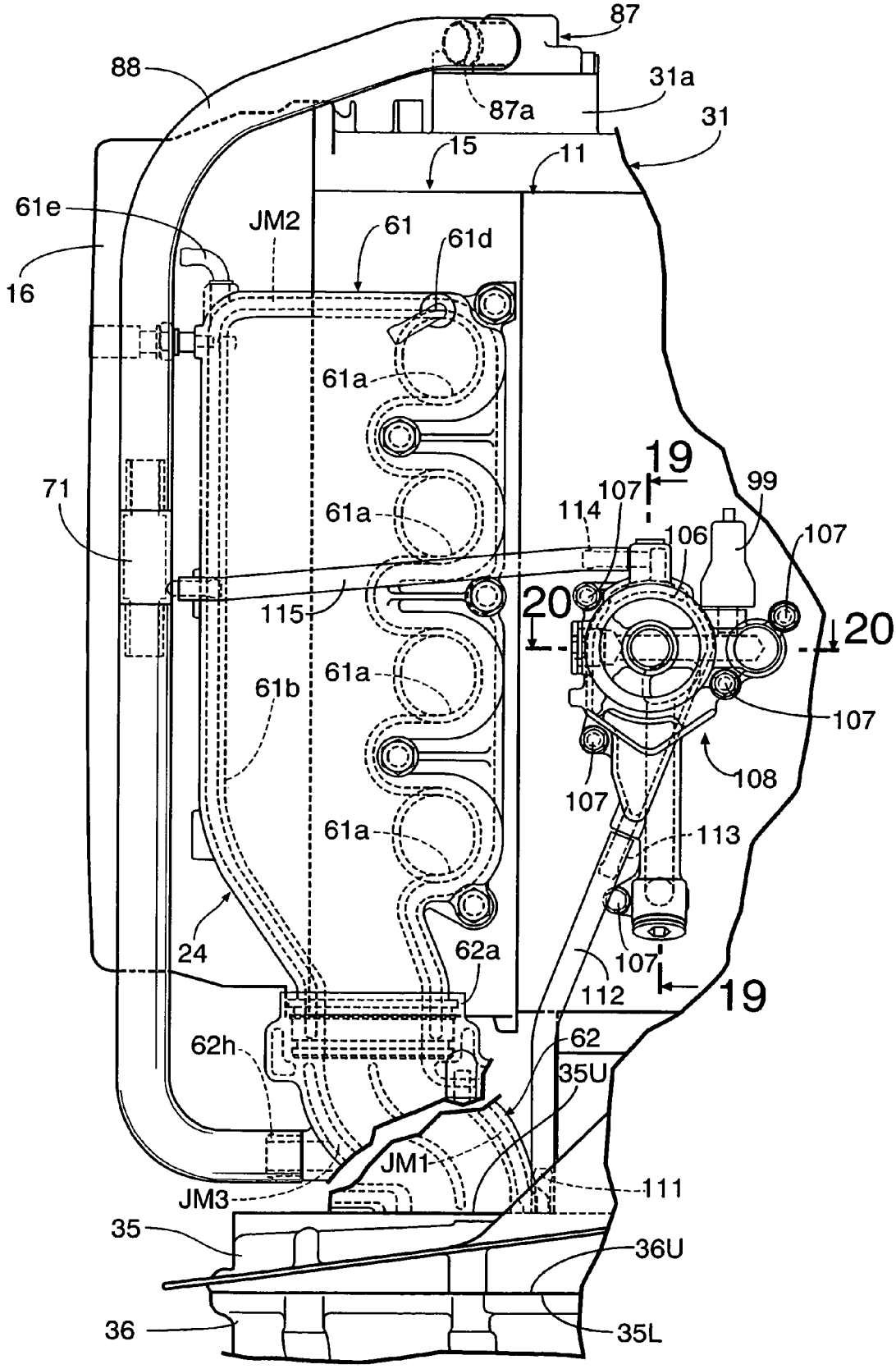
FIG. 5 is a view taken in a direction of an arrow 5 in FIG. 4.

As can be seen from FIGS. 4 and 5, two couplings 61*d* and 61*e* are provided at an upper portion of the exhaust manifold-cooling water jacket JM2, so that the cooling water in the exhaust manifold-cooling water jacket JM2 is discharged into the exhaust chamber 63 through the couplings 61*d* and 61*e* by a pipe line (not shown) or the like.

The structure of a cooling system in the cylinder block 11 will be described below with reference to FIGS. 3 and 7 to 9.

A slit-shaped cooling-water supply passage 34*a* formed to extend through the pump body 34 communicates with the slit-shaped cooling-water supply passage 35*e* (see FIG. 7) formed to extend through the mount case 35, and also communicates with a cooling-water supply passage 11*c* formed in the lower surface of the cylinder block 11 to extend laterally astride laterally widthwise central portions of the cylinders 17 and having the same mating-face shape as the cooling-water supply passage 35*e*. The cooling-water supply passage 11*c* in the cylinder block 11 is in the form of a groove with its lower surface opened, and communicates with a lower end of a cylinder block-cooling water jacket JB for the cylinder block 11 through two through-bores 11*d* and 11*e* extending through an upper wall of the groove.

The structure of a cooling system in the cylinder head 15 will be described below with reference to FIGS. 3, 6, 9 and 13.

Two short cooling-water supply passages 11*g* and 11*h* are branched toward the cylinder head 15 from a sidewall of the slit-shaped cooling-water supply passage 11*c* formed in the lower surface of the cylinder block 11, and communicate with a cylinder head-cooling water jacket JH for the cylinder head 15 through a gasket 56 between the cylinder block 11 and the cylinder head 15. The cylinder block-cooling water jacket JB surrounding the cylinders 17 in the cylinder block 11 is isolated from the cylinder head-cooling water jacket JH for the cylinder head 15 through the gasket 56 interposed between coupled surfaces of the cylinder block 11 and the cylinder head 15 (see FIGS. 2 and 6).

First and second thermostats 85 and 86 are accommodated within a thermostat-mounting seat 31*a* provided on the chain cover 31 covering the upper surfaces of the cylinder block 11 and the cylinder head 15, and upper ends JBe and JHe (see FIG. 12) of the cylinder block-cooling water jacket JB and the cylinder head-cooling water jacket JH are connected to the first and second thermostats 85 and 86, respectively. A draining pipe 88 extending from a coupling 87*a* of a thermostat cover 87 covering the thermostat-mounting seat 31*a* is connected to the second exhaust gas guide-cooling water jacket JM3 through a coupling 62*h* (see FIGS. 4 and 5) provided on the exhaust gas guide 62.

Figure 11:
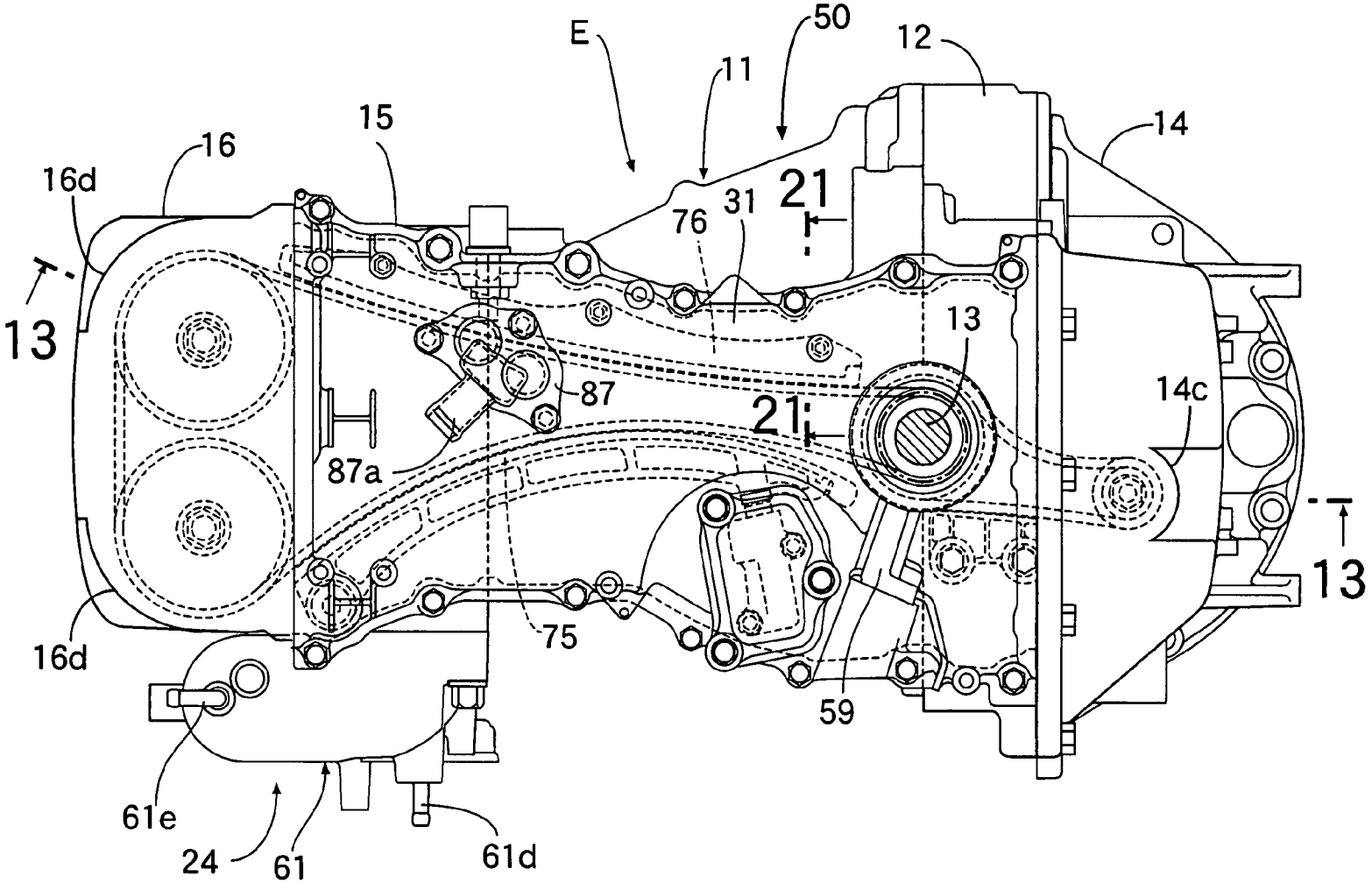
FIG. 11 is an enlarged view taken along a line 11—11 in FIG. 1.

The structure of a system for driving camshafts 73, 73 and balancer shafts 78 and 79 by the crankshaft 13 will be described below with reference to FIGS. 11 to 13.

The timing chain 30 comprising a silent chain generating less noise is less noise is reeved around a cam-driving sprocket 72 mounted at the upper end of the crankshaft 13 and cam follower sprockets 74, 74 mounted on a pair of camshafts 73, 73 located at a rear portion of the cylinder head 15. A hydraulic chain tensioner 75 is mounted in abutment against a loosened side of the timing chain 30, and a chain guide 76 is mounted in abutment against an opposite side of the timing chain 30. The number of teeth of the cam-driving sprocket 72 is half of the number of teeth of each of the cam follower sprockets 74, 74 and hence, the camshafts 73, 73 are rotated at a number of rotations half of that of the crankshaft.

Figure 21:
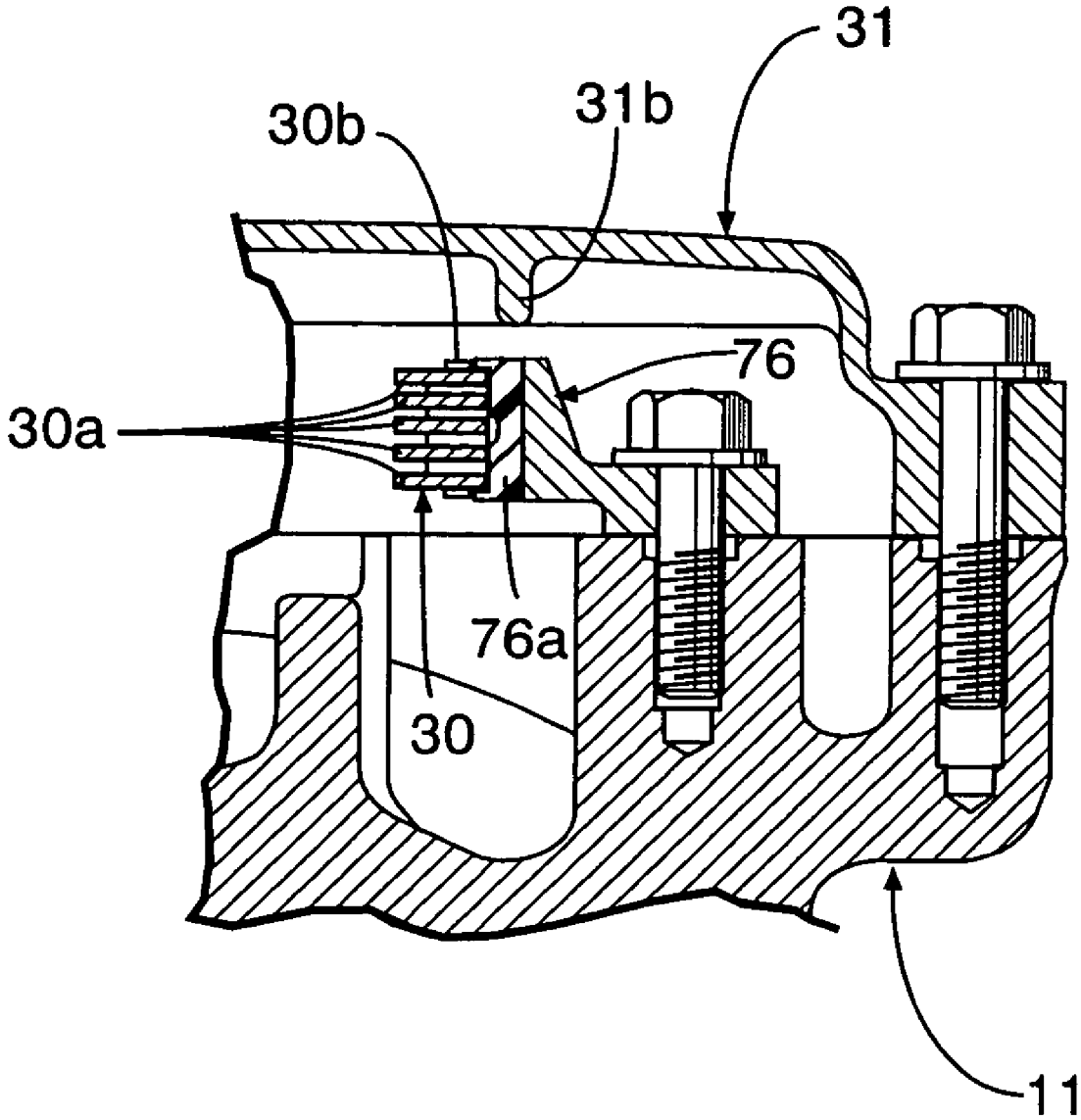
FIG. 21 is an enlarged sectional view taken along a line 21—21 in FIG. 11.

As shown in detail in FIG. 21, the timing chain 30 comprising the silent chain includes a plurality of plates 30*a* connected together in an endless fashion by pins 30*b*, so that teeth formed on the plates 30*a* are meshed with the cam-driving sprocket 72 and the cam follower sprockets 74, 74. The timing chain 30 is guided along a synthetic resin guide portion 76*a* made provided on the chain guide 76.

A balancer device 77 is accommodated within the crankcase 14, and a balancer-driving chain 82 comprising a silent chain is reeved around a balancer follower sprocket 80 mounted on one of two balancer shafts 78 and 79 and around a balancer-driving sprocket 81 mounted on the crankshaft 13. A chain tensioner 83 is mounted in abutment against a loosened side of the balancer-driving chain 82, and a chain guide 84 is mounted in abutment against an opposite side of the balancer-driving chain 82. The number of teeth of the balancer-driving sprocket 81 is twice as large as that of balancer follower sprocket 80 and hence, the balancer shafts 78 and 79 are rotated at a number of rotations twice as large as that of the crankshaft 13.

The cam-driving sprocket 72, the cam follower sprockets 74 and the timing chain 30 constitute a first chain mechanism 89, and the balancer-driving sprocket 81, the balancer follower sprocket 80 and the balancer-driving chain 82 constitute a second chain mechanism 90.

The chain cover 31, an upper portion of the crankcase 14 and an upper portion of the head cover 16 define a chain chamber 54 in which the first and second chain mechanisms 89 and 90 are accommodated.

Figure 12:
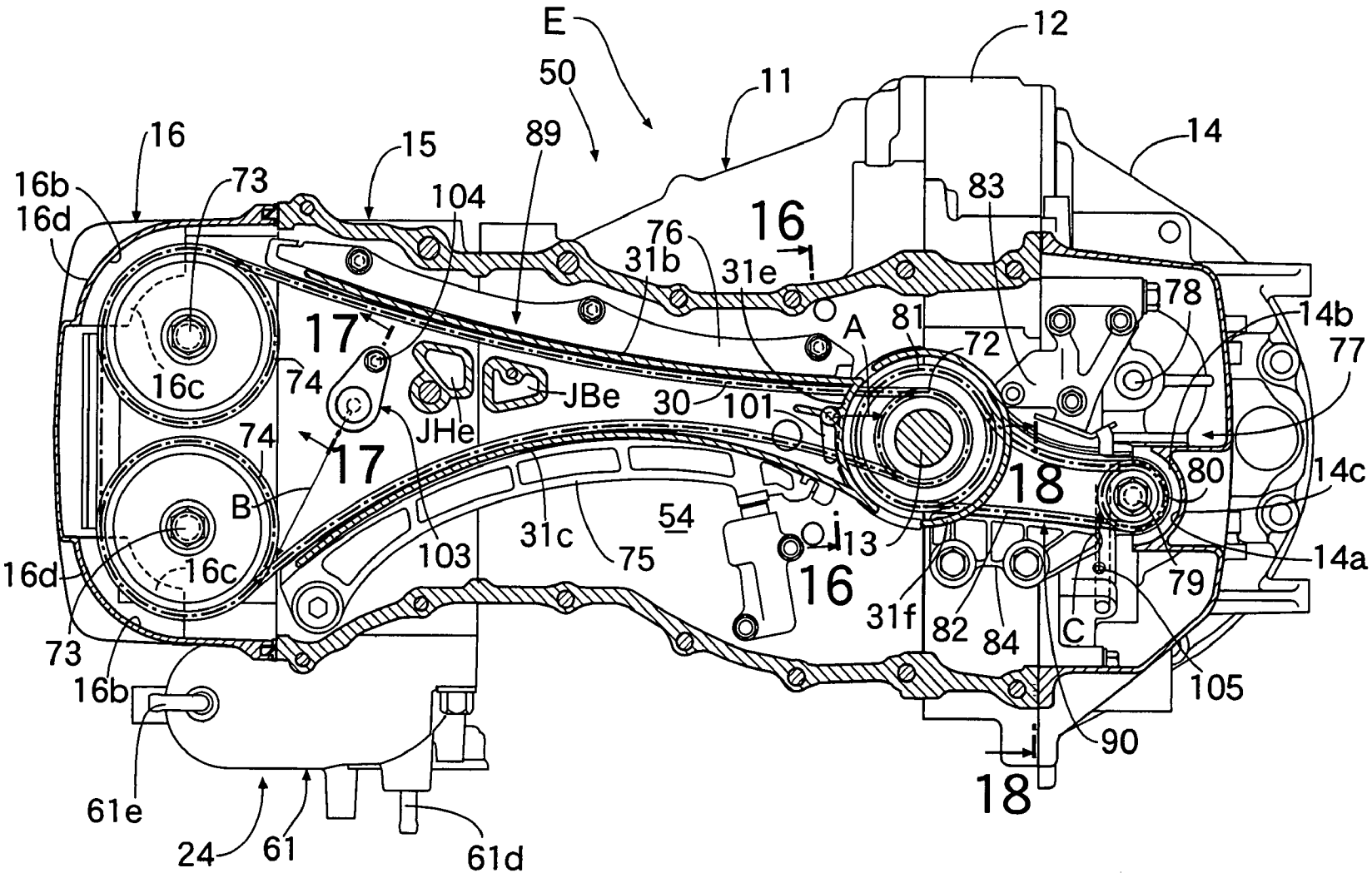
FIG. 12 is an enlarged sectional view taken along a line 12—12 in FIG. 1.
Figure 14:
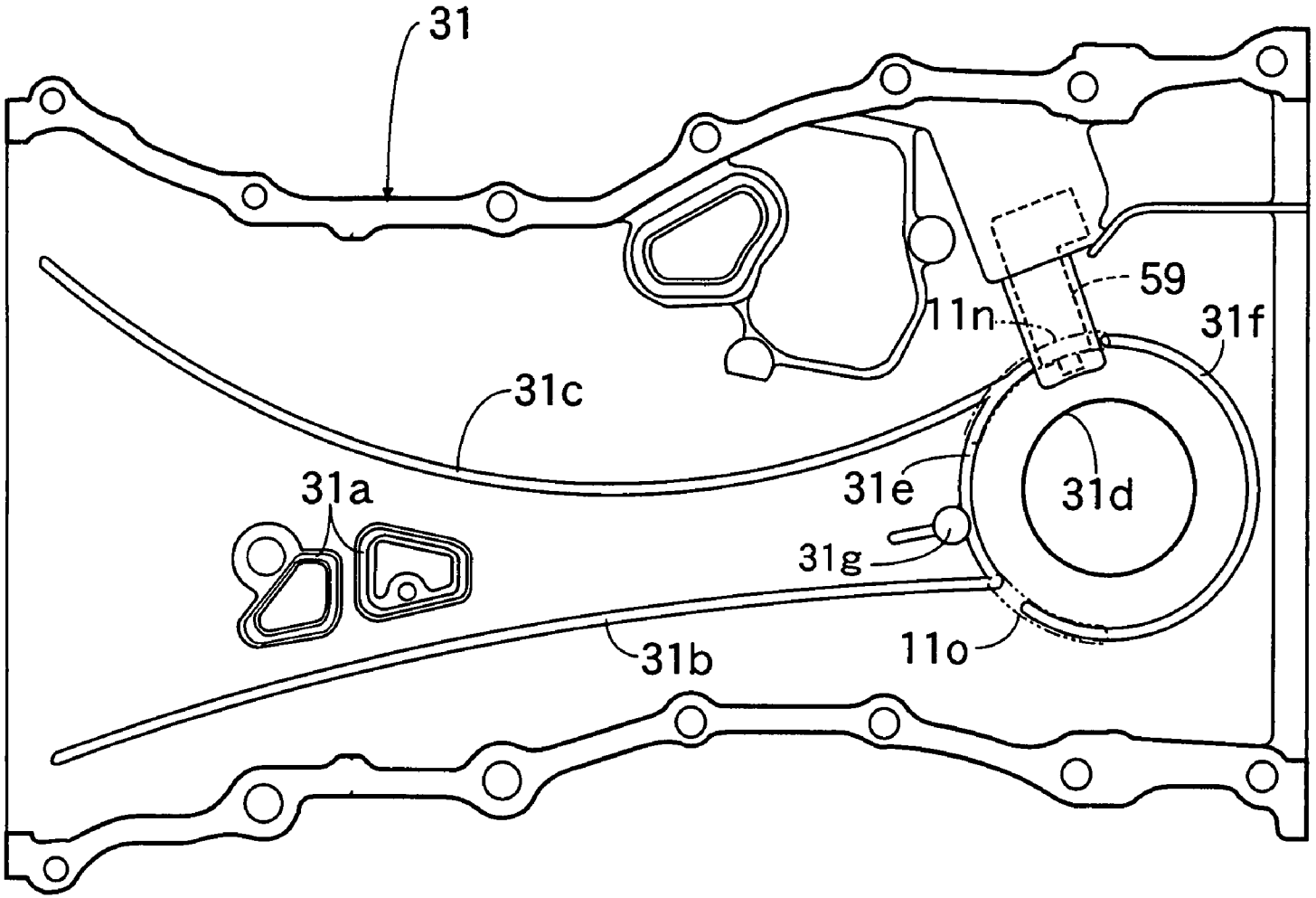
FIG. 14 is an enlarged view taken along a line 14—14 in FIG. 1.

As can be seen from FIGS. 12, 14 and 21, first and second curved ribs 31*b* and 31*c* hang from a lower surface of the chain cover 31. A lower surface of the first rib 31*b* is disposed in proximity to an upper surface of the chain 30 which is moved along the chain guide 76 fixed to the upper surfaces of the cylinder block 11 and the cylinder head 15, and a lower surface of the second rib 31*c* is disposed in proximity to the upper surface of the chain 30 which is moved along the chain tensioner 75 mounted on the upper surfaces of the cylinder block 11 and the cylinder head 15.

A third circular rib 31*e* also hangs from the lower surface of the chain cover 31 to surround a portion of a periphery of an opening 31*d* through which the crankshaft 13 extends, and the first and second ribs 31*b* and 31*c* are connected at their ends to opposite ends of the third rib 31*e*, respectively. Further, a fourth arcuate rib 31*f* hangs from the lower surface of the chain cover 31 to surround a portion of the periphery of the opening 31*d*. That is, the substantially entire region of the outer periphery of the opening 31*d* is surrounded by the third and fourth ribs 31*e* and 31*f*. Lower ends of the first, second and third ribs 31*b*, 31*c* and 31*e* terminate in locations higher in level than the upper end of the timing chain 30, but a lower end of the fourth rib 31*f* extends at substantially the same level as the lower end of the timing chain 30 and to a location higher in level than the lowermost packing face of the chain cover 31.

A detecting portion of an engine rotational speed sensor 59 for detecting a rotational speed of the crankshaft 13 is inserted into a clearance formed between opposed ends of the third and fourth ribs 31*e* and 31*f*, and is opposed an outer peripheral surface of a rotational speed-detecting rotor 60 fixed to the crankshaft 13.

Figure 15:
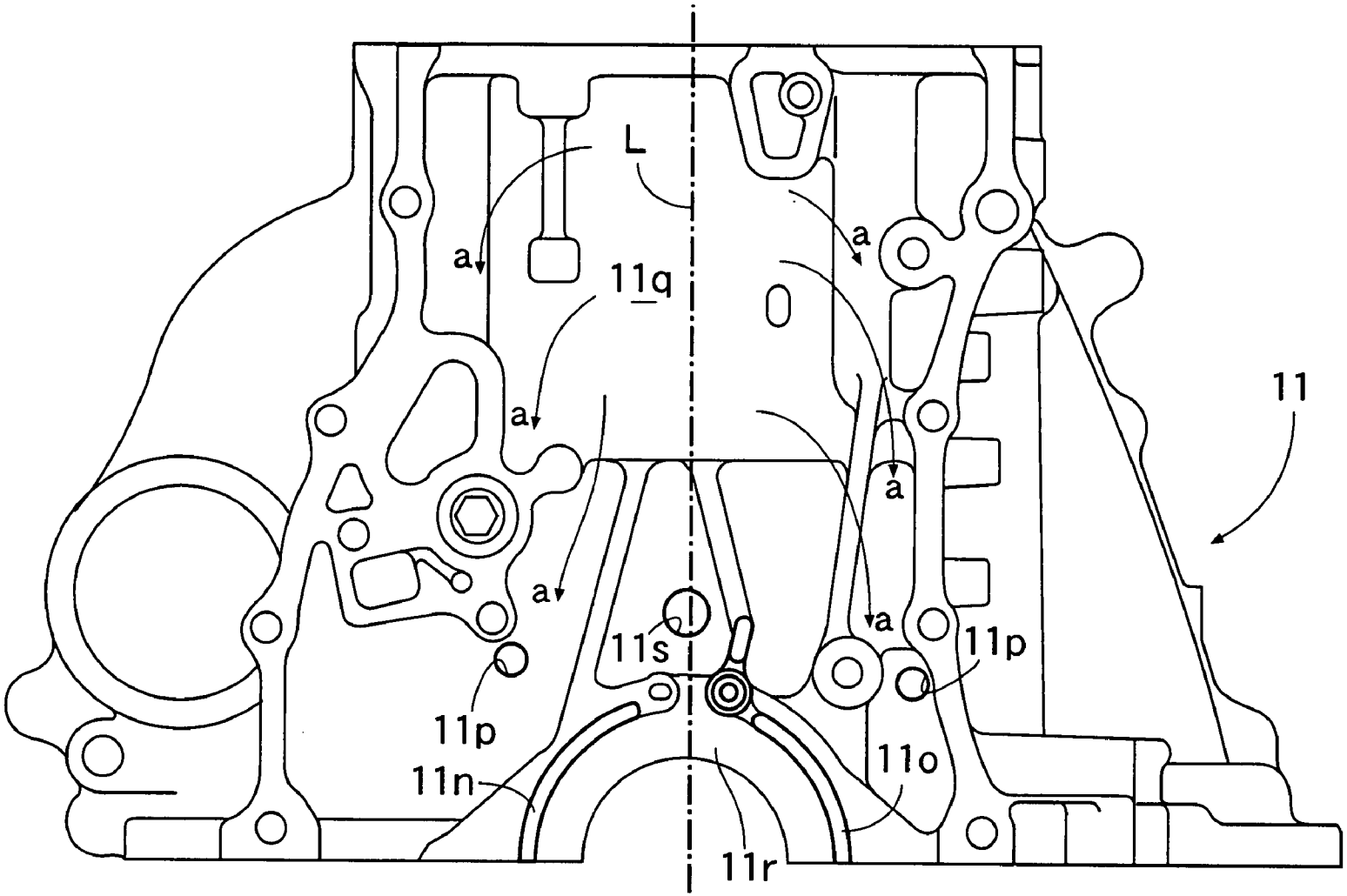
FIG. 15 is an enlarged view taken along a line 15—15 in FIG. 1.

As can be seen from FIGS. 14 and 15, first and second arcuate ribs 11*n* and 11*o* protrude upwards from the upper surface of the cylinder block 11, and upper ends of the first and second ribs 11*n* and 11*o* are opposed to the lower ends of the third and fourth ribs 31*e* and 31*f* of the chain cover 31.

As can be seen from FIGS. 11 to 14 and 18, the crankcase 14 covering the balancer device 77 includes a vertical wall 14*a* disposed to surround substantially a half of the balancer-driving sprocket 81 farther from the crankshaft 13, and an arcuate horizontal wall 14*b* extending in a horizontal direction from a lower end of the vertical wall 14*a* so that it is opposed to a lower surface of the balancer-driving sprocket 81. The vertical wall 14*a* and the horizontal wall 14*b* are formed integrally with the crankcase 14 by providing a recess 14*c* (see FIG. 11) protruding inwards at a portion of the crankcase 14.

The head cover 16 covering the valve-operating mechanism 27 includes: vertical walls 16*b*, 16*b* each disposed to surround approximately one fourth of an outer periphery of a travel locus of the timing chain 30 on a side of each of the pair of cam follower sprockets 74, 74 farther from the crankshaft 13; and arcuate horizontal walls 16*c*, 16*c* extending in a horizontal direction from lower ends of the vertical walls 16*b*, 16*b*, so that they are opposed to the lower surfaces of the cam follower sprockets 74, 74. The vertical walls 16*b*, 16*b* and the horizontal walls 16*c*, 16*c* are formed integrally with the head cover 16 by providing recesses 16*d*, 16*d* (see FIG. 11) protruding inwards at a portion of the head cover 16.

The structure of a lubricating system for the vertical engine E will be described below.

As shown in FIGS. 3, 4 and 6 to 9, the oil case 36 is integrally provided with an oil pan 36*d*, and accommodates a suction pipe 92 including an oil strainer 91. An oil suction passage 33*a*, an oil discharge passage 33*b* and an oil relief passage 33*c* are provided in the oil pump 33. The oil suction passage 33*a* is connected to a suction pipe 92; the oil discharge passage 33*b* extends from an outlet which extends to a back of a sheet surface of FIG. 8 and is connected to various portions to be lubricated of the vertical engine E via an oil passage (not shown) in the mount case 35 and an oil supply bore 11*m* (see FIG. 9) formed in the lower surface of the cylinder block 11; and the oil relief passage 33*c* is adapted to discharge the oil returned from the oil pump 33 into the oil pan 36*d*.

A portion of the oil returned from the valve-operating mechanism 27 provided in the cylinder head 15 and the head cover 16 is returned to the oil pan 36*d* through a coupling 16*a* mounted in the head cover 16, an oil hose 93 and an oil return passage 35*g* (see FIG. 7) extending through the mount case 35, and another portion of the oil returned from the valve-operating mechanism 27 is returned to the oil pan 36*d* via an oil return passage 15*b* (see FIGS. 6 and 9) formed in the cylinder head 15, an oil return passage 11*j* (see FIG. 9) opening into the packing surfaces of the cylinder block 11 and the cylinder head 15, an oil return passage 11*k* (see FIG. 9) extending through the cylinder block 11, an oil return passage 34*b* (see FIG. 8) extending through the pump body 34 and the oil return passage 35*g* (see FIG. 7) extending through the mount case 35. The oil return passage 11*j* opening into the gasket 56 between the cylinder block 11 and the cylinder head 15 is disposed so that it is interposed between two cooling-water passages 11*g* and 11*h* opening into the oil return passage 11*j* (see FIG. 3).

The oil returned from the crankcase 14 is returned to the oil pan 36*d* through an oil return passage (not shown) extending through the pump body 34 and the oil return passage 35*g* (see FIG. 7) extending through the mount case 35.

As can be seen from FIGS. 3 and 15, two oil return bores 11*p*, 11*p* are formed in an upper wall of the cylinder block 11 covered with the chain cover 31, so that they are disposed on the left and right sides of a cylinder axis L. A bulged portion 11*q* of a partially cylindrical shape corresponding to the upper most cylinder 17 protrudes upwards on the cylinder axis L; other portions of the cylinder block 11 are at locations lower in level than the bulged portion 11*q*, and the oil return bores 11*p*, 11*p* open at such lower locations.

Five oil return bores 11*s* are formed on the cylinder axes L intermediate between the two oil return bores 11*p*, 11*p* to extend axially of the crankshaft 13 through five journal-supporting walls 11*r* for supporting journals 13*a* of the crankshaft 13. The uppermost oil return bore 11*s* communicates with the chain chamber 54, the lowermost oil return bore 11*s* communicates with the oil pan 36*d* via the inside of the mount case 35.

Figure 13:
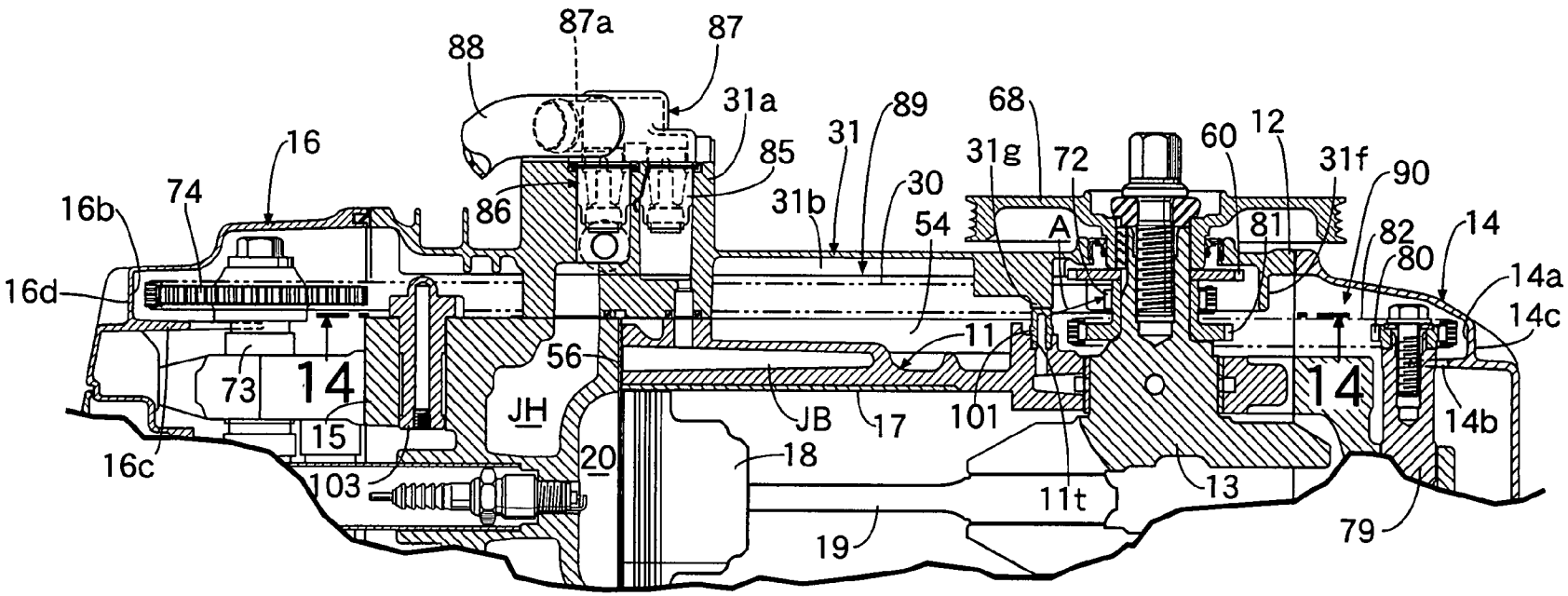
FIG. 13 is an enlarged sectional view taken along a line 13—13 in FIG. 11.
Figure 16:
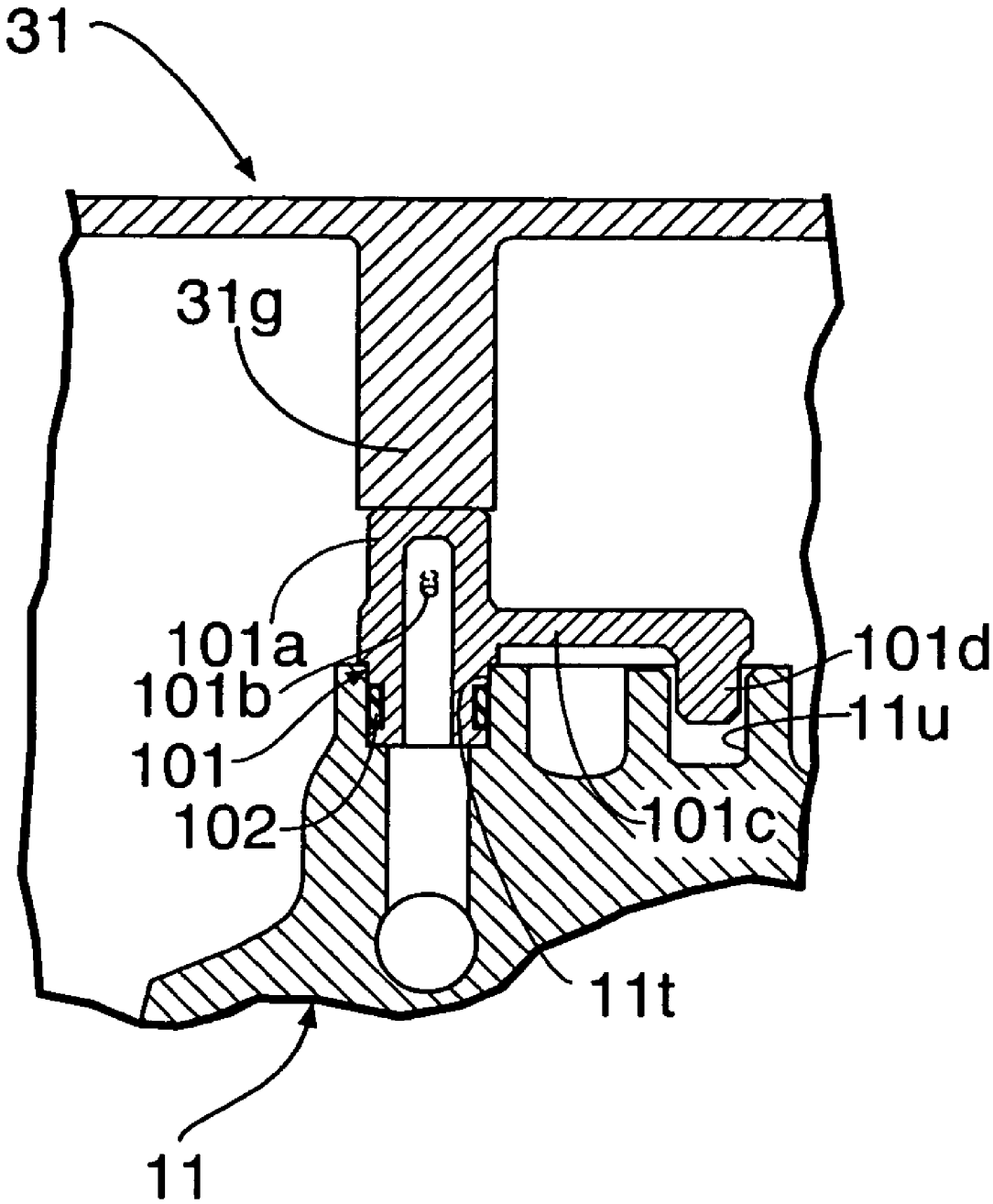
FIG. 16 is an enlarged sectional view taken along a line 16—16 in FIG. 12.

As can be seen from FIGS. 12, 13 and 16, a first oil jet 101 is mounted on the upper surface of the cylinder block 11 at a location closer to the crankshaft 13 to lubricate the timing chain 30 meshed with the cam-driving sprocket 72 mounted on the crankshaft 13 and the balancer-driving chain 82 meshed with the balancer-driving sprocket 81 mounted on the crankshaft 13.

The first oil jet 101 includes a jet body 101*a* fitted in an oil jet support bore lit formed in the cylinder block 11, a nozzle 101*b* opening into an upper portion of the jet body 101*a*, an arm portion 101*c* extending sideways from the jet body 101*a*, and a positioning projection 101*d* formed at a tip end of the arm portion 101*c* and fitted in a positioning bore 11*u* in the cylinder block 11. A seal member 102 is mounted around an outer periphery of the jet body 101*a* fitted in the oil jet support bore 11*t*. In order to fix the first oil jet 101 to the cylinder block 11, a retaining projection 31*g* hanging from a ceiling surface of the chain cover 31 is provided to abut against an upper surface of the jet body 101*a*.

In this way, the first oil jet 101 is fitted in the oil jet support bore 11*t* in the cylinder block 11, and the retaining projection 31*g* of the chain cover 31 is provided to abut against the upper end of the jet body 101*a*. Therefore, it is possible to fix the first oil jet 101 without need for a special fixing member such as a bolt; a thick boss having a bolt bore is not required to be mounted in a narrow space in the vicinity of the crankshaft 13; and the first oil jet 101 can be disposed easily.

The nozzle 101*b* of the first oil jet 101 points diagonally upwards through a space below the third rib 31*e* hanging from the ceiling surface of the chain cover 31, and injects the oil supplied from the oil jet support bore 11*t* toward the cam-driving sprocket 72 mounted on the crankshaft 13, as shown by an arrow A in FIGS. 12 and 13.

Figure 17:
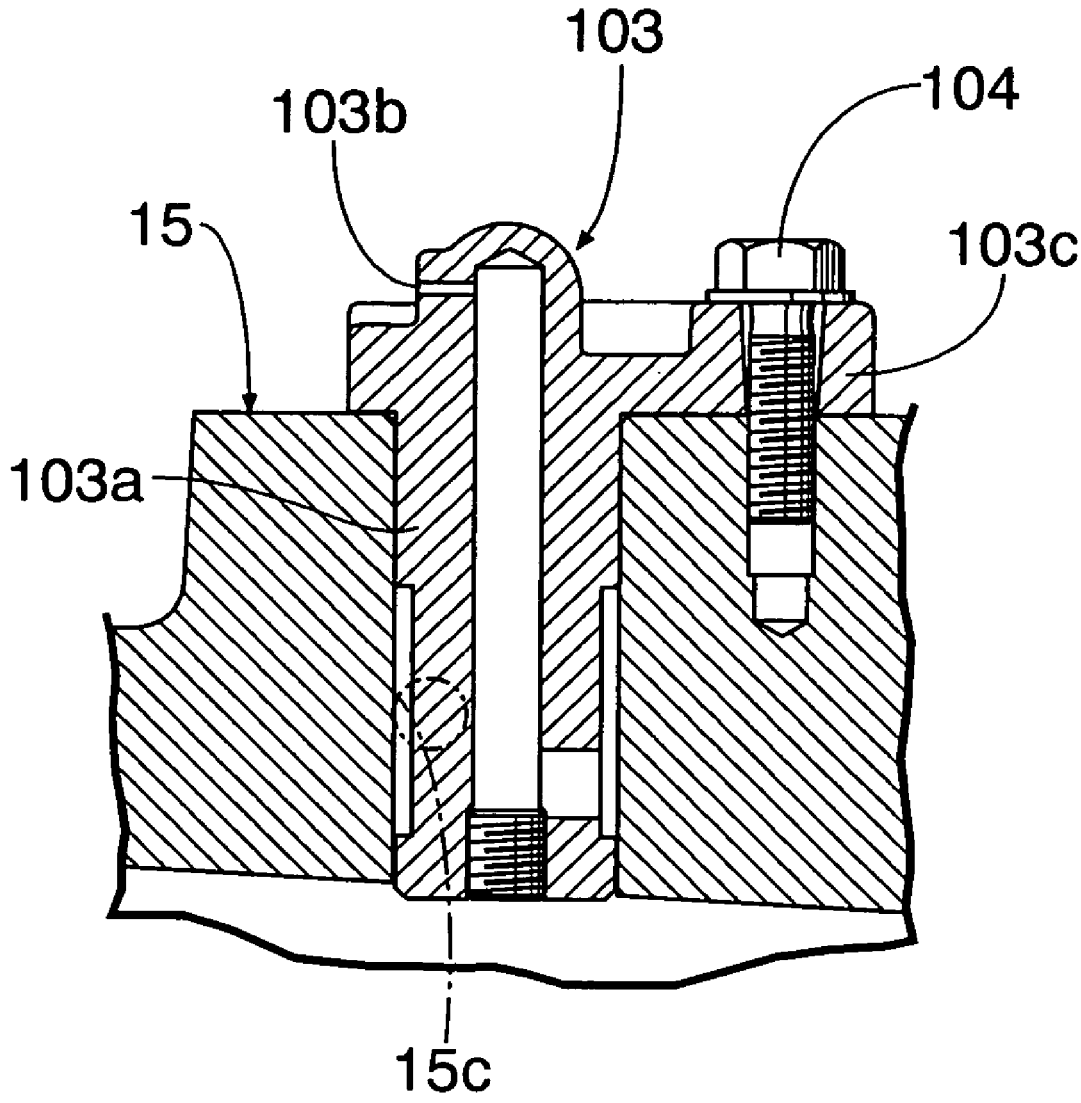
FIG. 17 is an enlarged sectional view taken along a line 17—17 in FIG. 12.

As can be seen from FIGS. 12, 13 and 17, a second oil jet 103 for lubricating the timing chain 30 meshed with the cam follower sprocket 74 mounted on one of the camshafts 73 is mounted on the upper surface of the cylinder head 15. The second oil jet 103 includes a jet body 103*a* fitted in an oil supply passage 15*c* formed in the cylinder head 15, a nozzle 103*b* opening substantially horizontally into an upper portion of the jet body 103*a*, and an arm portion 103*c* extending sideways from the jet body 103*a*. The second oil jet 103 is fixed to the cylinder head 15 by a bolt 104 passed through the arm portion 103*c*.

The oil injected substantially horizontally by the second oil jet 103 points to a position in which the timing chain 30 is meshed with the one cam follower sprocket 74 in the vicinity of an upstream end of the chain tension 75, as shown by an arrow B in FIG. 12.

Figure 18:
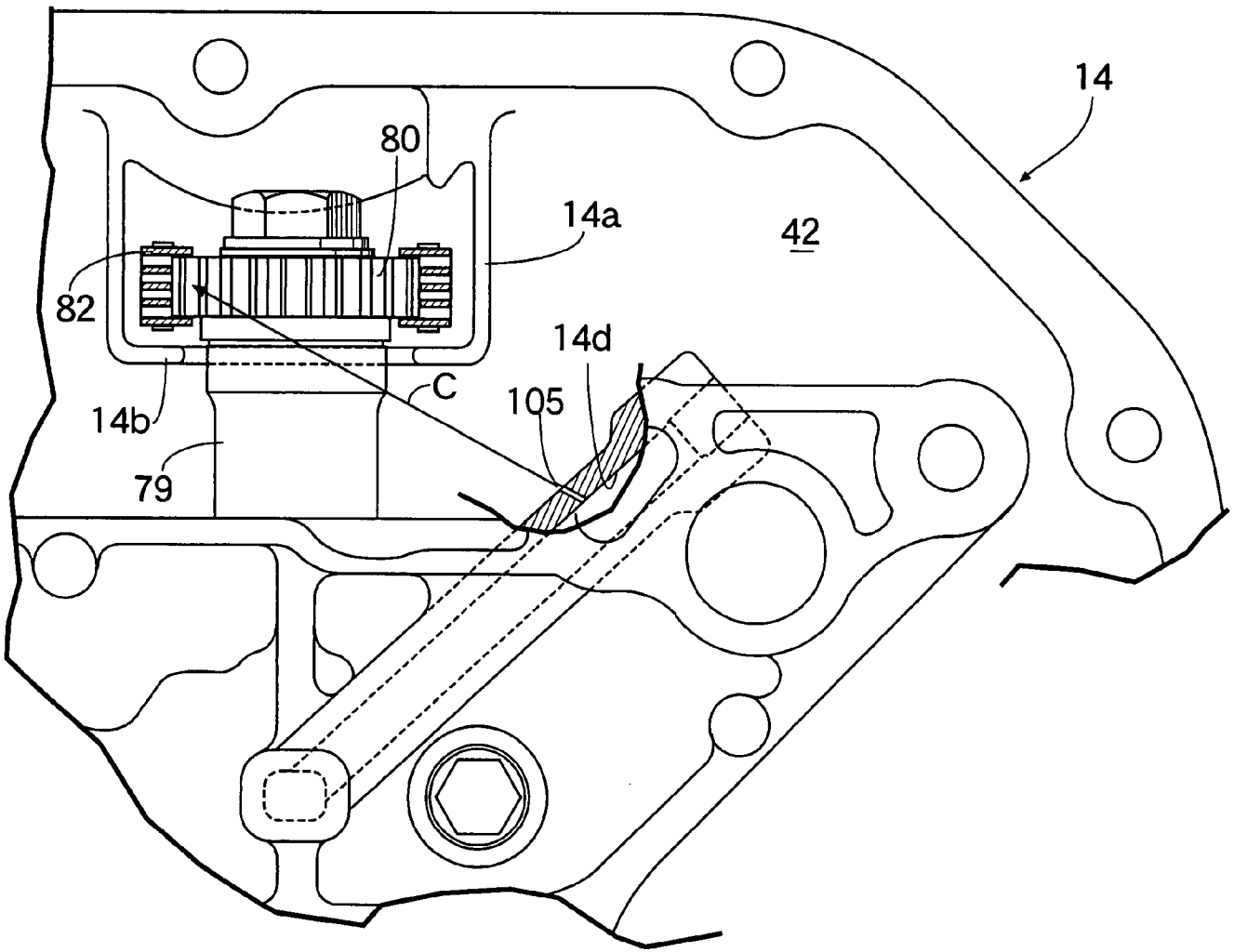
FIG. 18 is an enlarged sectional view taken along a line 18—18 in FIG. 12.
Figure 19:
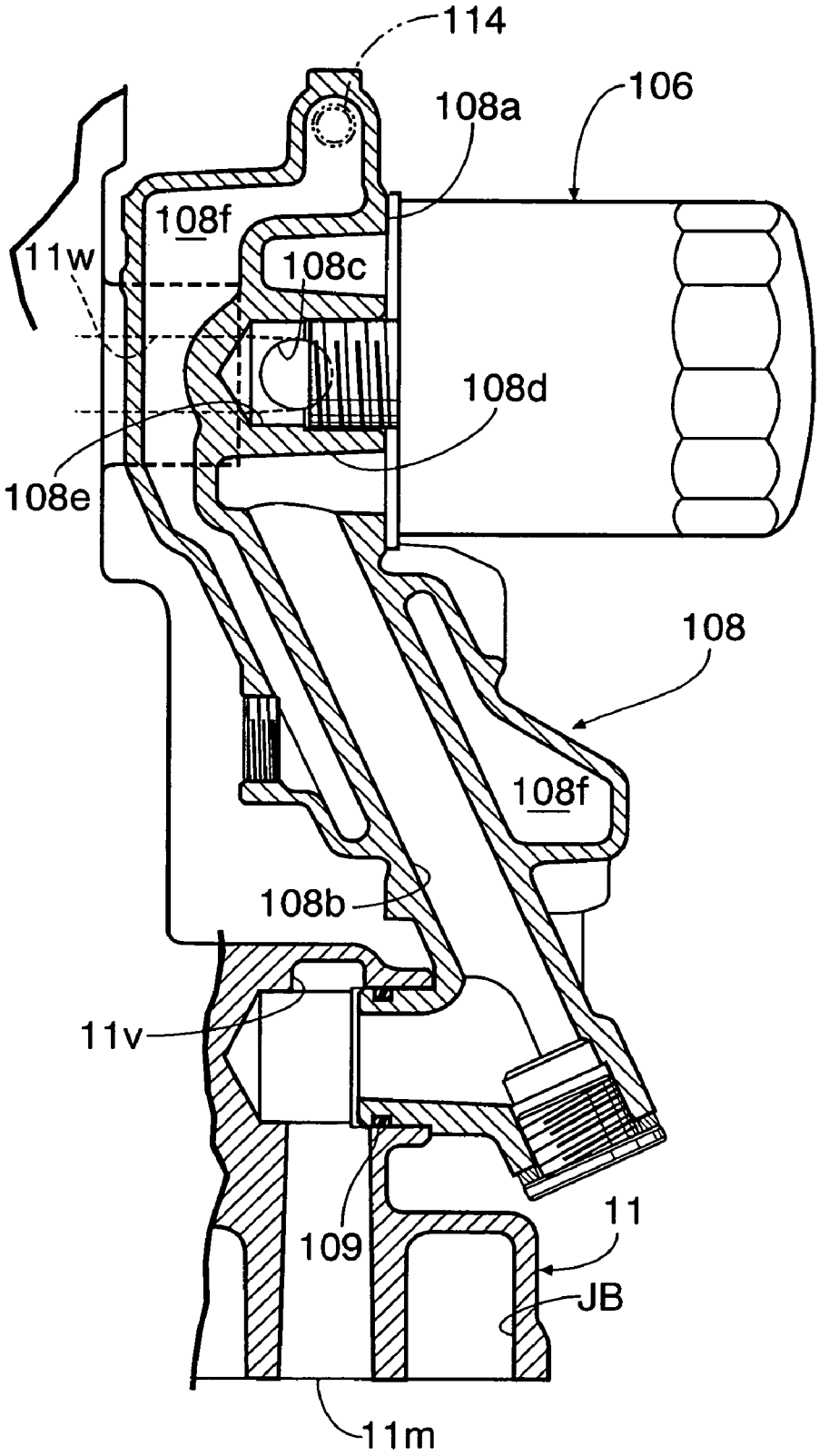
FIG. 19 is an enlarged sectional view taken along a line 19—19 in FIG. 5.

As can be seen from FIGS. 12 and 18, a third oil jet 105 for lubricating the balancer-driving chain 82 meshed with the balancer follower sprocket 80 mounted on the one balancer shaft 79 is mounted within the crankcase 14. The third oil jet 105 opens diagonally upwards into an oil supply passage 14*d* formed in the crankcase 14, and the oil injected diagonally upwards by the third oil jet 105 points to the balancer-driving chain 82 immediately before being meshed into the balancer follower sprocket 80, as shown by an arrow C in FIG. 12.

Figure 20:
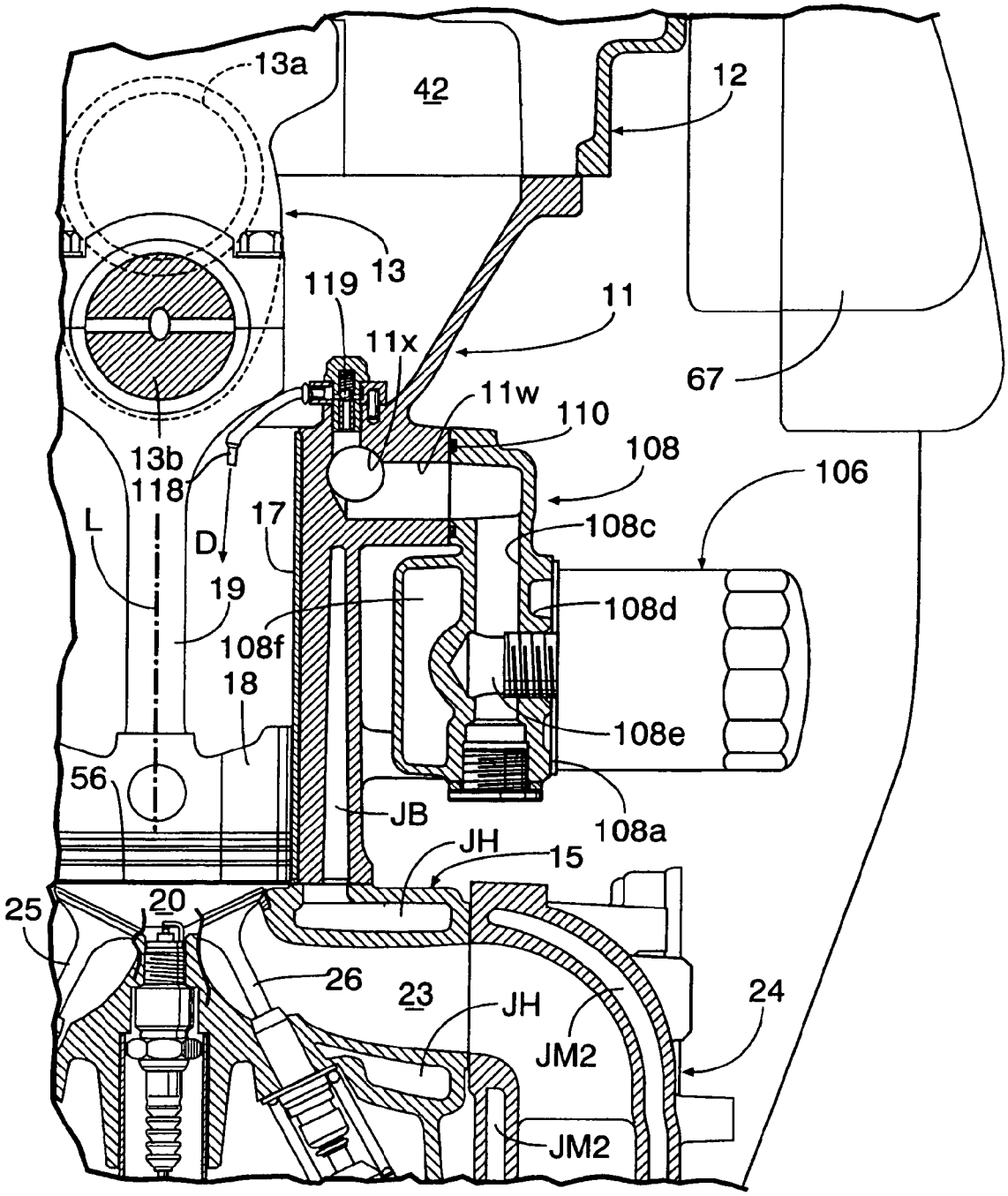
FIG. 20 is an enlarged sectional view taken along a line 20—20 in FIG. 5.

As can be seen from FIGS. 3 and 20, two fourth oil jets 118, 118 are mounted in correspondence to upper two 17, 17 of the four cylinders 17, 17, 17, 17 vertically juxtaposed to have the generally horizontal cylinder axes L. The fourth oil jets 118, 118 are mounted for the purpose of cooling the pistons 18, 18, unlike the first, second and third oil jets 101, 103 and 105 mounted mainly for the purpose of lubrication. If the hydraulic pressure in a main gallery 11x extending vertically within the cylinder block 11 exceeds a predetermined value, check valves 119, 119 each receiving a predetermined set load are opened, whereby the fourth oil jets 118, 118 inject the oil in a direction of an arrow D toward rear faces of the piston 18, 18 slidably received in the two cylinders 17, 17.

The structure around an oil filter 106 will be described below with reference to FIGS. 3, 5, 19 and 20.

The oil filter 106 having a cylindrical shape as a whole is mounted on a right side of the cylinder block 11, and screwed into and fixed to a circular oil filter-mounting seat 108*a* of a base member 108 fixed to the cylinder block 11 by five bolts 107. An inlet-side oil supply passage 108*b* and an outlet-side oil supply passage 108*c* are formed within the base member 108. The inlet-side oil supply passage 108*b* communicates at its lower end with an oil supply passage 11*v* in the cylinder block 11 through a seal member 109 and has an oil flow-in portion 108*d* at its upper end, which opens into an outer periphery of the oil filter-mounting seat 108*a*. The outlet-side oil supply passage 108*c* communicates at one end thereof with an oil flow-out portion 108*e* which opens into a central portion of the oil filter-mounting seat 108*a*, and at the other end with the main gallery 11*x* through a seal member 110 and via an oil supply passage 11*w*.

As shown in FIGS. 5 and 7, a coupling 111 is mounted on the upper surface 35U of the mount case 35 to communicate with a source for supplying the cooling water to the relief valve 51, and a cooling-water supply hose 112 extending from the coupling 111 is connected to a coupling 113 at a lower end of the base member 108. A cooling-water discharge hose 115 extending from a coupling 114 mounted at an upper end of the base member 108 is connected to a coupling 71 mounted at an intermediate portion of the draining pipe 88.

A water jacket 108*f* connecting the lower coupling 113 and the upper coupling 114 to each other is provided within the base member 108 and disposed to completely surround the inlet-side oil supply passage 108*b*, and the outlet-side oil supply passage 108*c* and the periphery of the oil filter-mounting seat 108*a* of the base member 108.

The operation of the embodiment of the present invention having the above-described arrangement will be described below.

Figure 22:
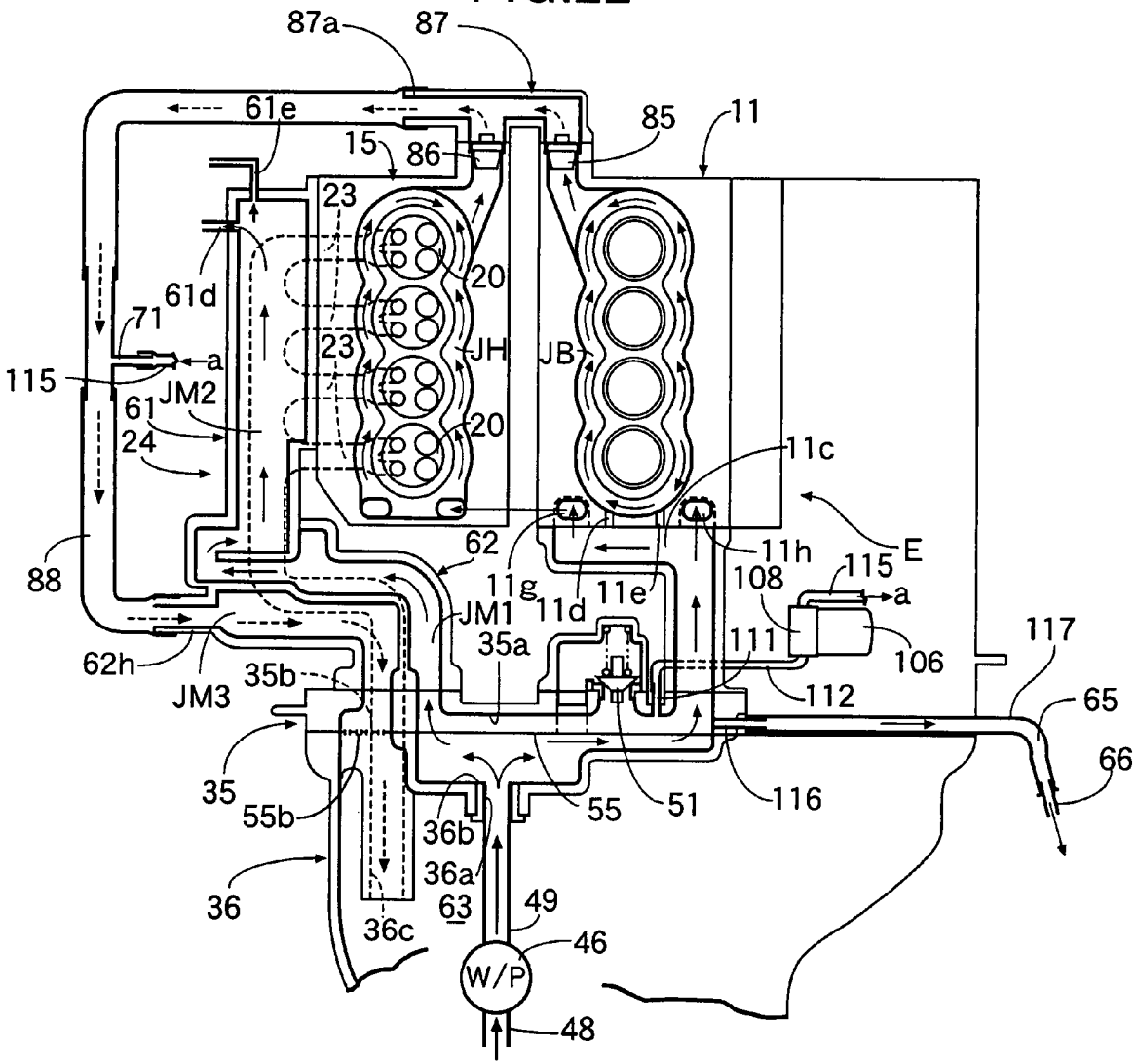
FIG. 22 is a circuit diagram of an engine-cooling system.

First, the operation concerning the cooling of the vertical engine E will be described with reference mainly to a cooling-water circuit in FIG. 22.

When the drive shaft 41 connected to the crankshaft 13 is rotated by the operation of the vertical engine E, the cooling-water pump 46 mounted on the drive shaft 41 is operated to supply the cooling water drawn up through the strainer 47 to the cooling-water supply port 36*a* in the lower surface of the oil case 36 through the lower water supply passage 48 and the upper water supply passage 49. The cooling water passed through the cooling-water supply port 36*a* flows into the cooling-water supply passage 36*b* in the oil case 36 and the cooling-water supply passage 35*a* in the mount case 35, and a portion of the cooling water branched therefrom is supplied to the first exhaust gas guide-cooling water jacket JM1 formed in the exhaust gas guide 62 of the exhaust passage 24 within the engine room and the exhaust manifold-cooling water jacket JM2 formed in the exhaust manifold 61. An exhaust gas discharged from the combustion chambers 20 in the cylinder head 15 is discharged to the exhaust chamber 63 via the single pipe portions 61*a* and the collection portion 61*b* of the exhaust manifold 61, the exhaust passage 62*d* in the exhaust gas guide 62, the exhaust passage 35*b* in the mount case 35 and the exhaust pipe portion 36*c* in the oil case 36, and the exhaust passage 24 within the engine room heated to a higher temperature by the exhaust gas during this process is cooled by the cooling water flowing through the first exhaust gas guide-cooling water jacket JM1 and the exhaust manifold-cooling water jacket JM2.

The cooling water having a high temperature as a result of flowing upward through the first exhaust gas guide-cooling water jacket JM1 and the exhaust manifold-cooling water jacket JM2 is discharged from the couplings 61*d* and 61*e* mounted at the upper end of the exhaust manifold 61 through the pipe line (not shown) to the exhaust chamber 63.

A portion of the cooling water of a lower temperature supplied to the cooling-water supply passages 36*b* and 35*a* connected to the cooling-water supply port 36*a* flows through the two through-bores 11*d* and 11*e* opening into the cooling-water supply passage 11*c* in the lower end of the cylinder block 11 into the lower end of the cylinder block-cooling water jacket JB. The portion of the cooling water of the lower temperature supplied to the cooling-water supply passages 36*b* and 35*a* also flows from the cooling-water supply passage 11*c* in the lower end of the cylinder block 11 via the two cooling-water supply passages 11*g* and 11*h* into the lower end of the cylinder head-cooling water jacket JH.

During the warming operation of the vertical engine E, the first thermostat 85 connected to the upper end of the cylinder block-cooling water jacket JB and the second thermostat 86 connected to the upper end of the cylinder head-cooling water jacket JH are in closed states, and the cooling water in the cylinder block-cooling water jacket JB and the cylinder head-cooling water jacket JH resides therein without flowing and hence, the warming of the vertical engine E is promoted. During this process, the cooling-water pump 46 is continued to be rotated, but is brought into a substantially racing state by the leakage of the cooling water from a motor impeller made of a rubber.

When the temperature of the cooling water is raised after completion of the warming operation of the vertical engine E, the first and second thermostats 85 and 86 are opened, whereby the cooling water in the cylinder block-cooling water jacket JH and the cooling water in the cylinder head-cooling water jacket JH flow from the common coupling 87*a* of the thermostat cover 87 via the draining pipe 88 and the coupling 62*h* of the exhaust gas guide 62 into the second exhaust gas guide-cooling water jacket JM3. The cooling water which has cooled the exhaust gas guide 62 while flowing through the second exhaust gas guide-cooling water jacket JM3 is passed upward to flow through the mount case 35 and the oil case 36, and discharged into the exhaust chamber 63. When the rotational speed of the vertical engine E is increased to cause the internal pressure in the cooling-water supply passages 36*b* and 35*a* to become equal to or higher than a predetermined value, the relief valve 51 is opened, thereby permitting the surplus cooling water to be discharged into the exhaust chamber 63.

The cooling water diverted from an upstream side of the relief valve 51 into the cooling-water supply hose 112 flows into the lower end of the water jacket 108*f* in the base member 108 of the oil filter 106, and while flowing upwards through the water jacket 108*f*, the cooling water cools the oil flowing through the inlet-side oil supply passage 108*b* and the outlet-side oil supply passage 108*c* formed in the base member 108, and flows through the oil filter-mounting seat 108*a* for the oil filter 106 to cool the oil within the oil filter 106. The cooling water after the heat exchange with the oil is discharged from the upper end of the water jacket 108*f* through the cooling-water discharge hose 115 into an intermediate portion of the draining pipe 88.

Figure 23:
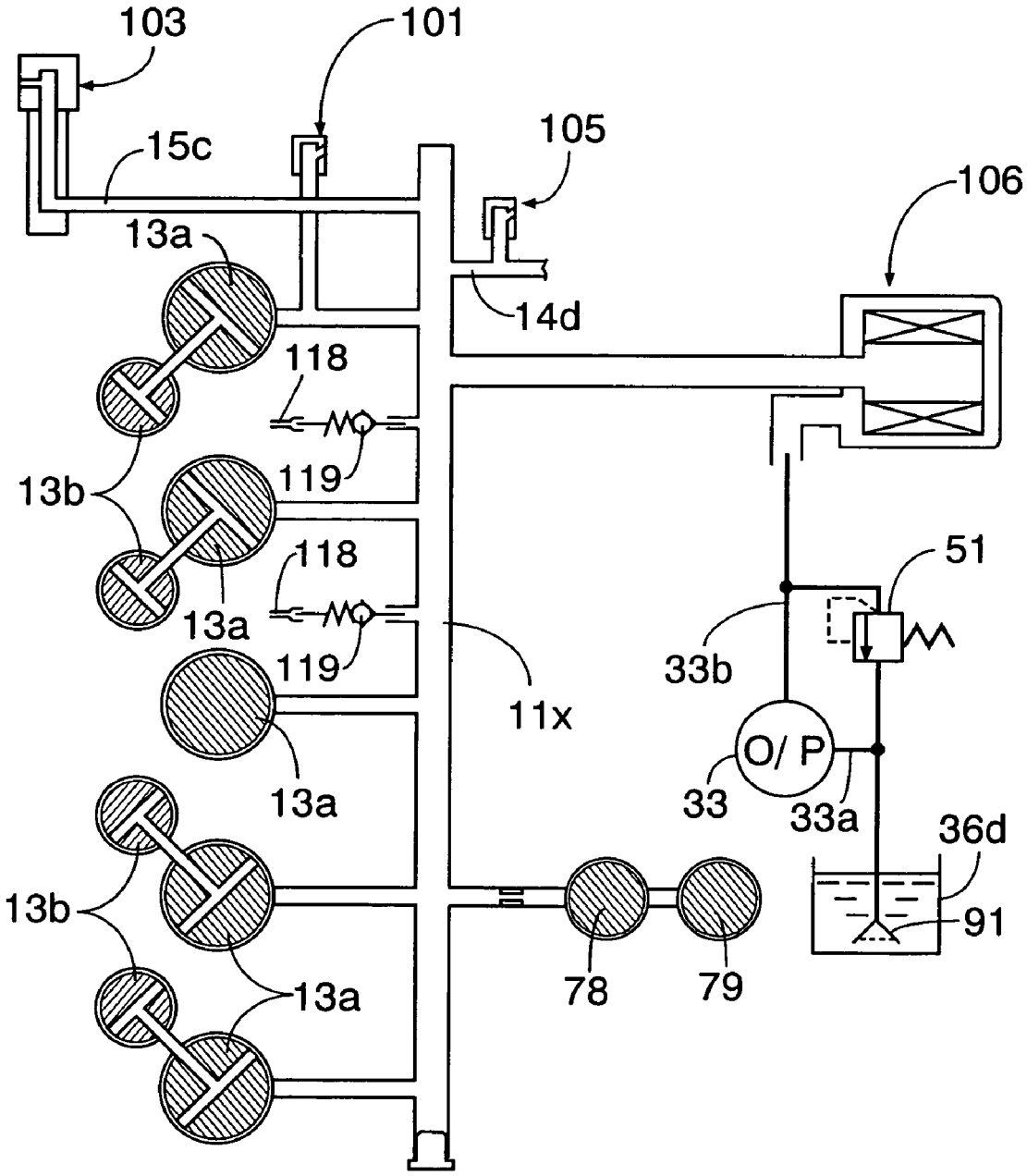
FIG. 23 is a circuit diagram of an engine-lubricating system.

Then operation concerning the lubrication of the vertical engine E will be described below with reference mainly to an oil circuit in FIG. 23.

The oil in the oil pan 36*d* is drawn into the oil pump 33 through the oil strainer 91 and the oil suction passage 33*a* (see FIG. 8), and the oil discharged by the oil pump 33 is supplied from the oil discharge passage 33*b* (see FIG. 8) through the oil passage in the mount case 35 into the oil supply bore 11*m* (see FIG. 9) formed in the lower surface of the cylinder block 11. At this time, the surplus oil discharged by the oil pump 33 is passed through the relief valve 51 and returned to the suction side of the oil pump 33. The relived oil may be returned to the oil pan 36*d*.

The oil supplied to the oil supply passage 11*v* (see FIG. 3) in the cylinder block 11 is supplied therefrom via the inlet-side oil supply passage 108*b* in the base member 108 to the oil filter 106 (see FIGS. 19 and 20), and the oil after being filtered is supplied from the outlet-side oil supply passage 108*c* in the base member 108 via the oil supply passage 11*w* in the cylinder block 11 to the main gallery 11*x* vertically formed in the cylinder block 11. The oil diverted from the main gallery 11*x* lubricates the journals 13*a* and the crankpins 13*b* of the crankshaft 13 and also lubricates the two balancer shafts 78 and 79.

As described above, the base member 108 separate from the cylinder block 11 is formed with the inlet-side oil supply passage 108*b* for supplying the oil to the oil filter 106 and the outlet-side oil supply passage 108*c* for discharging the oil from the oil filter 106. Therefore, it is unnecessary to increase the thickness of the wall of the cylinder block 11 or to form a bulged portion surrounding the oil passages in order to form the outlet-side oil supply passage 108*c* and the inlet-side oil supply passage 108*b*. This can contribute to a reduction in weight of the cylinder block 11. Moreover, because the inlet-side oil supply passage 108*b* and the outlet-side oil supply passage 108*c* are formed in the base member 108, their layouts can be established freely without being restricted to the shape of the cylinder block 11 to contribute an increase in degree of freedom for the design.

In addition, because the water jacket 108*f* facing the inlet-side oil supply passage 108*b*, the outlet-side oil supply passage 108*c* and the oil filter-mounting seat 108*a* are formed in the base member 108 supporting the oil filter 106, the degree of freedom for the layout of the water jacket 108*f* can be increased as compared with a case where the water jacket is formed in the cylinder block 11. Moreover, the lower-temperature cooling water which is not heated and which has just exited from the cooling-water pump 46 is supplied to the water jacket 108*f* and hence, the oil can be cooled effectively by the cooling water flowing through the water jacket 108*f*. As a result, it is possible to enhance the lubricating effect and the cooling effect for portions to be lubricated such as sliding portions of the cylinders 17 and the pistons 18, the crankshaft 13, the camshafts 73, 73, the balancer shafts 78 and 79, the timing chain 30 and the balancer-driving chain 82.

The first oil jet 101 (see FIGS. 13 and 16) is connected to the oil jet support bore 11*t* diverted from the oil supply passage extending from the main gallery 11*x* to the uppermost journal 13*a*; the second oil jet 103 (see FIG. 17) is connected to the oil supply passage 15*c* diverted from the main gallery 11*x*, and the third oil jet 105 (see FIG. 18) is connected to the oil supply passage 14d diverted from the main gallery 11*x*.

The nozzle 101*b* of the first oil jet 101 injects the oil to the cam-driving sprocket 72 mounted at the upper end of the crankshaft 13 to lubricate the timing chain 30 reeved around the cam-driving sprocket 72. The balancer-driving sprocket 81 is mounted on the crankshaft 13 so that it is located immediately below the cam-driving sprocket 72, and the oil dropped from the cam-driving sprocket 72 is sprinkled on the balancer-driving sprocket 81 to lubricate the balancer-driving chain 82 reeved around the balancer-driving sprocket 81.

In this way, the cam-driving sprocket 72 and the balancer-driving sprocket 81 are disposed at vertical two stages, and the oil can be injected toward the cam-driving sprocket 72 disposed at the upper stage, whereby the oil colliding with the cam-driving sprocket 72 and dropping therefrom can be brought into contact with the balancer-driving sprocket 81, thereby effectively lubricating both the cam-driving sprocket 72 and the balancer-driving sprocket 81. At this time, the oil dropping from the cam-driving sprocket 72 can be brought further effectively into contact with the balancer-driving sprocket 81, leading to an enhancement in lubricating effect, because the diameter of the balancer-driving sprocket 81 disposed at the lower stage is set to be larger than that of the cam-driving sprocket 72 disposed at the upper stage.

The periphery of the cam-driving sprocket 72 to which the oil is injected from the first oil jet 101 is surrounded by the third and fourth arcuate ribs 31*e* and 31*f* hanging from the ceiling surface of the chain cover 31. Therefore, it is possible to prevent the injected oil from being scattered wastefully, thereby further enhancing the effect of lubricating the cam-driving sprocket 72 and the balancer-driving sprocket 81.

The oil injected from the nozzle 103*b* of the second oil jet 103 points to the position in which the timing chain 30 is meshed into the one cam follower sprocket 74, and moreover, this position is largely spaced apart from a position in which the first oil jet 101 is mounted. Therefore, the entire region of the timing chain 30 can be lubricated equally by cooperation between the first and second oil jets 101 and 103.

The first and second ribs 31*b* and 31*c* hanging from the ceiling surface of the chain case 31 are disposed in proximity to the upper surface of the timing chain 30. Therefore, the oil flowing down from the ceiling surface along the first and second ribs 31*b* and 31*c* is positively supplied to sliding portions between the pins 30*b* and the bores in the plurality of plates 30*a* of the timing chain 30 and sliding portions between the timing chain 30 and the chain guide 76 to lubricate them. Particularly, in the timing chain 30 comprising the silent chain, the plates 30*a* and the sprocket are meshed directly with each other, and a driving force for the chain acts directly on the sliding portions of the bores in the plates 30*a* and the pins 30*b*. However, the wear of the sliding portions can be alleviated by supplying a sufficient amount of the oil to them through the first and second ribs 31*b* and 31*c* to provide the lubricating effect, as described above.

The two recesses 16*d*, 16*d* of the head cover 16 are provided with the horizontal walls 16*c*, 16*c* opposed to the lower surface of the timing chain 30, and hence the dropped oil can be accumulated temporarily on the horizontal walls 16*c*, 16*c* to lubricate the timing chain 30 traveling through the horizontal walls 16*c*, 16*c*. Moreover, the oil can be guided in an entraining direction along an arcuate travel locus of the timing chain 30 by cooperation with the vertical walls 16*b*, 16*b* opposed to the outer peripheral surface of the timing chain 30. Therefore, it is possible to ensure the contact of the oil with the timing chain 30 over a long time and a long distance.

Further, the oil scattered diametrically outwards from the cam follower sprockets 74, 74 by a centrifugal force can be caught on the vertical walls 16*b*, 16*b*, and the oil flowing down along the vertical walls 16*b*, 16*b* can be retained on the horizontal walls 16*c*, 16*c*. Therefore, the oil can be brought effectively into contact with the timing chain 30 circulating at a predetermined distance along the vertical walls 16*b*, 16*b* and the horizontal walls 16*c*, 16*c*, thereby enhancing the lubricating effect. Moreover, because the vertical walls 16*b*, 16*b* and the horizontal walls 16*c*, 16*c* are integrally formed by providing the recesses 16*d*, 16*d* on a portion of the head cover 16, there is no possibility that the number of parts is increased.

The oil injected from the third oil jet 105 points to the position in which the balancer-driving chain 82 is meshed into the balancer follower sprocket 80 and moreover, this position is largely spaced apart from a position in which the first oil jet 101 is mounted. Therefore, the entire region of the balancer-driving chain 82 can be lubricated equally by cooperation between the first and third oil jets 101 and 105.

Because the recess 14*c* of the crankcase 14 is provided with the horizontal wall 14*b* opposed to the lower surface of the balancer-driving chain 82, the dropped oil can be accumulated temporarily on the horizontal wall 14*b* to lubricate the balancer-driving chain 82 passed through the horizontal wall 14*b*. Moreover, the oil can be guided in an entraining direction along an arcuate travel locus of the balancer-driving chain 82 by cooperation with the vertical wall 14*a* opposed to the outer peripheral surface of the balancer-driving chain 82. Therefore, it is possible to ensure the contact of the oil with the balancer-driving chain 82 over a long time and a long distance.

Further, the oil scattered radially outwards from the balancer follower sprocket 80 by a centrifugal force can be caught on the vertical wall 14*a*, and the oil flowing down along the vertical wall 14*a* can be retained on the horizontal walls 14*b*. Therefore, the oil can be brought effectively into contact with the balancer-driving chain 82 circulating at a predetermined distance along the vertical wall 14*a* and the horizontal wall 14*b*, thereby enhancing the lubricating effect. Moreover, because the vertical wall 14*a* and the horizontal wall 14*b* are integrally formed by providing the recess 14*c* on a portion of the crankcase 14, there is no possibility that the number of parts is increased.

In the embodiment, the vertical walls 16*b*, 16*b* and the horizontal walls 16*c*, 16*c* of the head cover 16 are formed integrally and continuously, but they may be formed by members separate from the head cover 16 and fixed to the head cover 16 at any locations. This is advantageous to absorb an error upon the assembling, if there is a slight clearance between each of the vertical walls 16*b*, 16*b* and each of the horizontal walls 16*c*, 16*c*.

Likewise, in the embodiment, the vertical wall 14*a* and the horizontal wall 11*b* of the crankcase 14 are formed integrally and continuously, but they may be formed by members separate from the crankcase 14 and fixed to the crankcase 14 at any locations. This is advantageous to absorb an error upon the assembling, if there is as light clearance between the vertical wall 14*a* and the horizontal wall 11*b*.

In general, if the timing chain 30 and the balancer-driving chain 82 are disposed at the upper ends of the crankshaft 13, the camshafts 73, 73 and the balancer shaft 79, it is impossible to expect an effect of sufficient lubrication of the timing chain 30 and the balancer-driving chain 82 by only the oil leaked from bearings of these shafts 13, 73, 73 and 79 and for this reason, a reduction in durability of these chains 30 and 82 is feared. Therefore, as in the present embodiment, the oil is injected from the first, second and third oil jets 101, 103 and 105 to the timing chain 30 and the balancer-driving chain 82; the oil scattered to the ceiling surface of the chain case 31 is guided to the timing chain 30 and the balancer-driving chain 82 by the first, second, third and fourth ribs 31*b*, 31*c*, 31*e* and 31*f*; and further, the oil is retained on the vertical walls 14*a*, 16*b*, 16*b* and the horizontal walls 14*b*, 16*c*, 16*c* formed on the crankcase 14 and the head cover 16, respectively, whereby an effect of sufficient lubrication of the timing chain 30 and the balancer-driving chain 82 can be ensured.

The first and second oil jets 101 and 103 are disposed at the opposite ends of the timing chain 30, and the first and third oil jets 101 and 105 are disposed at the opposite ends of the balancer-driving chain 82. Therefore, the oil can be injected equally to the entire regions of the timing chain 30 and the balancer-driving chain 82 to enhance the lubricating effect.

By the provision of the first and second oil jets 101 and 103 inside the travel locus of the timing chain 30, it is easy to dispose the first and second oil jets 101 and 103 within the narrow chain chamber 54. In addition, by the provision of the third oil jet 105 outside the travel locus of the balancer-driving chain 82, the third oil jet 105 can be disposed without hindrance, even when a space cannot be ensured inside such travel locus.

Further, even when the oil cannot be injected horizontally due to the presence of an obstacle, because the directions of injection of the oil from the first and third oil jets 101 and 103 are inclined with respect to the rotational planes of the timing chain 30 and the balancer-driving chain 82, the disposition of the first and third oil jets 101 and 105 cannot be impeded.

If a breather pipe is connected to the chain chamber 54, there is a possibility that the oil injected from each of the first, second and third oil jets 101, 103 and 105 into the chain chamber 54 may clog the breather pipe. In the present embodiment, however, the breather pipe 95 (see FIG. 2) is connected to the inside of the head cover 16 isolated from the chain chamber 54, whereby the breather pipe 95 can be prevented from being clogged with the oil.

The oil which has lubricated the first and second chain mechanisms 80 and 90, namely, the cam-driving sprocket 72, the cam follower sprockets 74, 74, the timing chain 30, the balancer-driving sprocket 81, the balancer follower sprocket 80 and the balancer-driving sprocket 82 in the above described manner is dropped through the oil return bores 11*p*, 11*p* and 11*s* (see FIGS. 3 and 15) formed in the upper surface of the cylinder block 11, and the oil is passed sequentially through the four oil return bores 11*s* (see FIG. 3) formed in the upper second and more journal support walls 11*r* of the cylinder block 11 to be returned to the oil pan 36*d*.

As can be seen from FIG. 15, the bulged portion 11*q* of the uppermost cylinder 17 protrudes on the upper surface of the cylinder block 11, and the left and right oil return bores 11*p*, 11*p* are formed at lowermost locations displaced from the bulged portion 11*q* toward the crankshaft 13. Therefore, the oil on such bulged portion 11*q* flows so that it is distributed to the opposite sides of the axis of the bulged portion 11*q*; and the oil is caught smoothly in the oil return bores 11*p*, 11*p*; and returned to the oil pan 36*d*.

The upper most oil return bore 11*s* disposed in the upper surface of the cylinder block 11 between the left and right oil return bores 11*p*, 11*p* is not necessarily required. In the present embodiment, the uppermost oil return bore 11*s* is secondarily formed in processing the four oil return bores 11*s* formed in the upper second and more journal support walls 11*r*.

In the process in which the oil injected into the chain chamber 54 is returned through the oil return bores 11*p*, 11*p* and 11*s* provided in the journal support walls 11*r* of the cylinder block 11 to the underlying oil pan 36*d*, the oil passed through the oil return bores 11*s* collides against the connecting rods 19, whereby it is scattered and brought into contact with the connecting rods 19, the pistons 18, the cylinders 17 and the like, to thereby contribute to the cooling the pistons 18 heated to a higher temperature by a heat from the combustion chamber 20. At the same time, the oil scattered by the centrifugal force after lubricating the journals 13*a* and the crankpins 13*b* of the crankshaft 13 is also brought into contact with the connecting rods 19, the pistons 18, the cylinders 17 and the like, to thereby contribute to the cooling of the pistons 18 by cooperation with the oil returned from the chain chamber 54.

The amount of the oil cooling the pistons 18 is larger at a location closer to the lower portion of the cylinder block 11 and hence, there is a tendency that the cooling of the upper piston(s) 18 is insufficient, and the cooling of the lower piston(s) 18 is excessive. In the present embodiment, however, the oil injected from the fourth oil jets 118, 118 mounted at upper two 17, 17 of the four cylinders 17 is brought into contact with the rear faces of the upper two pistons 18, 18 to exhibit a cooling effect, whereby the four pistons 18 can be cooled equally to prevent the occurrence of the insufficient cooling and excessive cooling. Moreover, the amount of the oil required for the cooling can be minimized to a necessary amount.

When the rear faces of the pistons 18, 18 are cooled by the oil injected from the fourth oil jets 118, 118, the temperature of the oil is liable to increase by the heat taken away from the pistons 18, 18. In the present embodiment, however, the rising of the temperature of the oil can be suppressed reliably, because the cooling effect of the oil in the oil filter 106 is extremely high.

Although the embodiment of the present invention has been described in detail, it will be understood that the present invention is not limited to the above-described embodiment, and various modifications in design may be made without departing from the spirit and scope of the invention defined in the claims.

For example, the vertical engine E used in the outboard engine system O has been illustrated in the embodiment, but the first, second, and forth to seventh features of the present invention are applicable to any vertical engine E not for the outboard engine system O.

What is claimed is:

1. A vertical engine comprising a crankshaft disposed in a generally vertical direction, an engine subassembly including a crank chamber in which the crankshaft is accommodated, an oil pan disposed below the engine subassembly, an oil filter disposed outside the engine subassembly, and an oil path for supplying an oil from the oil pan via the oil filter to portions to be lubricated, wherein the oil path includes a first oil passage which has an oil inlet opening into a lower surface of the engine subassembly and which rises upwards within the engine subassembly, and a second oil passage provided in a member separate from the engine subassembly and connecting a downstream portion of the first oil passage to an inlet of the oil filter, said member having an outer surface opposing an outer surface of the engine subassembly across a spacing therebetween.

2. A vertical engine according to claim 1, further including a third oil passage provided separately from the engine subassembly and connected to an outlet of the oil filter.

3. An outboard engine system provided with a vertical engine which comprises a crankshaft disposed in a generally vertical direction, a flywheel mounted at a lower end of the crankshaft, an engine subassembly including a crank chamber in which the crankshaft is accommodated, an oil pan disposed below the engine subassembly and below the flywheel, an oil filter disposed outside the engine subassembly, and an oil path for supplying an oil from the oil pan via the oil filter to portions to be lubricated, wherein the oil path includes a first oil passage which has an oil inlet opening into a lower surface of the engine subassembly and which rises upwards within the engine subassembly, a second oil passage provided in a member separate from the engine subassembly and connecting a downstream portion of the first oil passage to an inlet of the oil filter, and a third oil passage provided in said member separate from the engine subassembly and connected to an outlet of the oil filter, said member having an outer surface opposing an outer surface of the engine subassembly across a spacing therebetween.

4. A vertical engine comprising a crankshaft disposed in a generally vertical direction, an engine subassembly including a crank chamber in which the crankshaft is accommodated, an oil pan disposed below the engine subassembly, an oil filter disposed outside the engine subassembly, and an oil path for supplying an oil from the oil pan via the oil filter to portions to be lubricated, wherein the oil path includes a first oil passage which has an oil inlet opening into a lower surface of the engine subassembly and which rises upwards within the engine subassembly, and a second oil passage which is formed in a base member fixed to the engine subassembly to support the oil filter, and which connects a downstream portion of the first oil passage to an inlet of the oil filter, the base member being formed with a water jacket facing an oil-filter mounting seat, said base member having an outer surface opposing an outer surface of the engine subassembly, except in a region where the base member is fixed to the engine subassembly, across a spacing therebetween.

5. A vertical engine comprising a crankshaft disposed in a generally vertical direction, an engine subassembly including a crank chamber in which the crankshaft is accommodated, an oil pan disposed below the engine subassembly, an oil filter disposed outside the engine subassembly, and an oil path for supplying an oil from the oil pan via the oil filter to portions to be lubricated, wherein the oil path includes a first oil passage which has an oil inlet opening into a lower surface of the engine subassembly and which rises upwards within the engine subassembly, a second oil passage connecting a downstream portion of the first oil passage to an inlet of the oil filter, and a third oil passage connected to an outlet of the oil filter, the second and third oil passages being formed in a base member fixed to the engine subassembly to support the oil filter, the base member being formed with a water jacket facing the second oil passage, the third oil passage and an oil-filter mounting seat, said base member having an outer surface opposing an outer surface of the engine subassembly, except in a region where the base member is fixed to the engine subassembly, across a spacing therebetween.

6. A vertical engine according to claim 4 or 5, wherein the portions to be lubricated include sliding surfaces of a cylinder and a piston.

7. A vertical engine according to claim 4 or 5, wherein the portions to be lubricated include a timing chain adapted to drive a camshaft by the crankshaft.

8. An outboard engine system provided with a vertical engine according to claim 4 or 5, wherein a flywheel is mounted at a lower end of the crankshaft.

9. An outboard engine system provided with a vertical engine according to claim 6, wherein a flywheel is mounted at a lower end of the crankshaft.

10. An outboard engine system provided with a vertical engine according to claim 7, wherein a flywheel is mounted at a lower end of the crankshaft.

11. A vertical engine according to claim 1, wherein the second oil passage is elongated and extends along the outer surface of the engine subassembly, and a water jacket is formed inside the member and surrounds a substantial portion of the second oil passage.

12. An outboard engine system according to claim 3, wherein the second oil passage is elongated and extends along the outer surface of the engine subassembly, and a water jacket is formed inside the member and surrounds a substantial portion of the second oil passage.

13. A vertical engine according to claim 4, wherein the second oil passage is elongated and extends along the outer surface of the engine subassembly, and a water jacket is formed inside the member and surrounds a substantial portion of the second oil passage.

14. A vertical engine according to claim 5, wherein the second oil passage is elongated and extends along the outer surface of the engine subassembly, and a water jacket is formed inside the member and surrounds a substantial portion of the second oil passage.

* * * * *